United States Patent [19]

Ott

[11] Patent Number: 4,701,155

[45] Date of Patent: Oct. 20, 1987

[54] BUCKLE CHUTE FOLDER WITH CLAMP

[75] Inventor: Robert S. Ott, Dublin, Pa.

[73] Assignee: R. Funk & Co., Inc., Doylestown, Pa.

[21] Appl. No.: 884,475

[22] Filed: Jul. 11, 1986

[51] Int. Cl.[4] ..... B65H 45/14

[52] U.S. Cl. ..... 493/14; 493/23; 493/420

[58] Field of Search ..... 493/1, 2, , 3, 11, 14, 493/19, 21, 23, 29, 36, 417, 419, 420, 421, 444, 445, 458, 480

[56] References Cited

U.S. PATENT DOCUMENTS

| | | | |
|---|---|---|---|
| 2,857,827 | 10/1958 | Labombarde | 493/419 |
| 3,211,448 | 10/1965 | Stoothoff | 493/421 |
| 3,363,897 | 1/1968 | Northern et al. | 493/23 |
| 3,493,226 | 2/1970 | Weir | 493/19 |
| 3,797,820 | 3/1974 | McDermott | 493/19 |
| 3,856,293 | 12/1974 | Boyer | 493/421 |
| 3,899,166 | 8/1975 | Behn | 493/36 |
| 4,061,326 | 12/1977 | Proudman | 493/14 |

FOREIGN PATENT DOCUMENTS

| | | | |
|---|---|---|---|
| 2945773 | 5/1981 | Fed. Rep. of Germany | 493/419 |
| 3417420 | 12/1984 | Fed. Rep. of Germany | 493/3 |

*Primary Examiner*—Robert P. Olszewski
*Assistant Examiner*—William E. Terrell
*Attorney, Agent, or Firm*—Albert L. Free

[57] ABSTRACT

A folder suitable for automatically folding successive sheets of paper, such as engineering drawings, by conveying them into a folder pocket to various distances depending upon where the fold is to be formed. To arrest the sheet at the proper position in the pocket, a photosensor senses when the leading edge of the sheet has reached a reference position in the pocket and, when the sheet has advanced further to the desired position, a solenoid-operated clamp is actuated to move transversely into the pocket and clamp the sheet momentarily in the desired position while the fold is being made. The amount by which the sheet advances beyond the reference position is controlled by producing an electrical pulse each time the sheet conveyor moves a predetermined amount, and counting these pulses to cause the clamp to be actuated when a count corresponding to the desired fold position has been accumulated.

9 Claims, 26 Drawing Figures

FIG. 13A
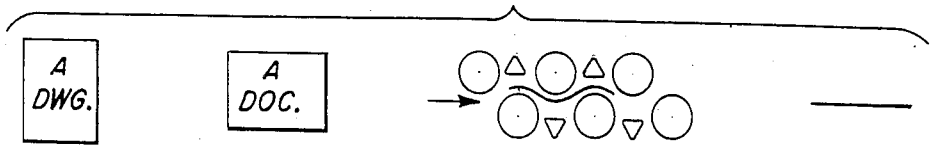
FIG. 13B
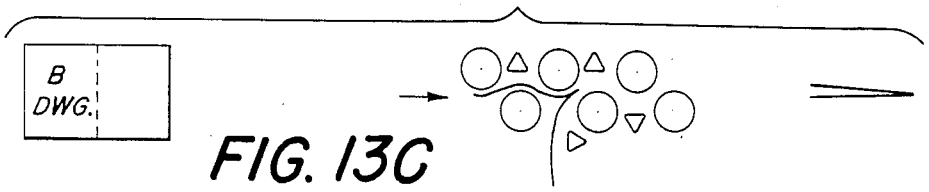
FIG. 13C
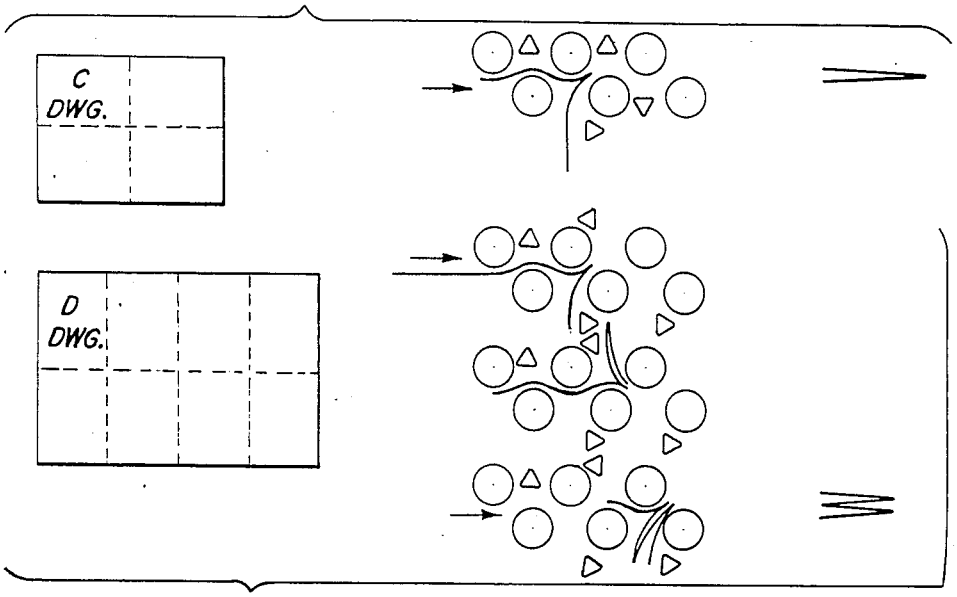
FIG. 13D
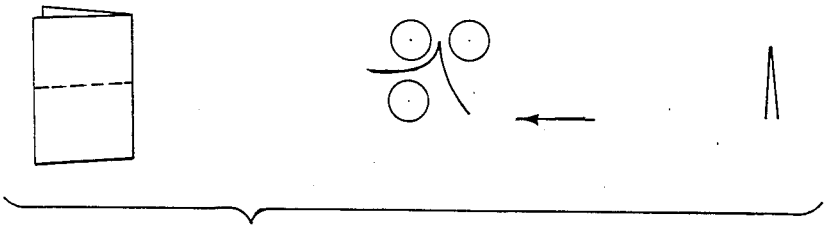
FIG. 13E FIG. 15
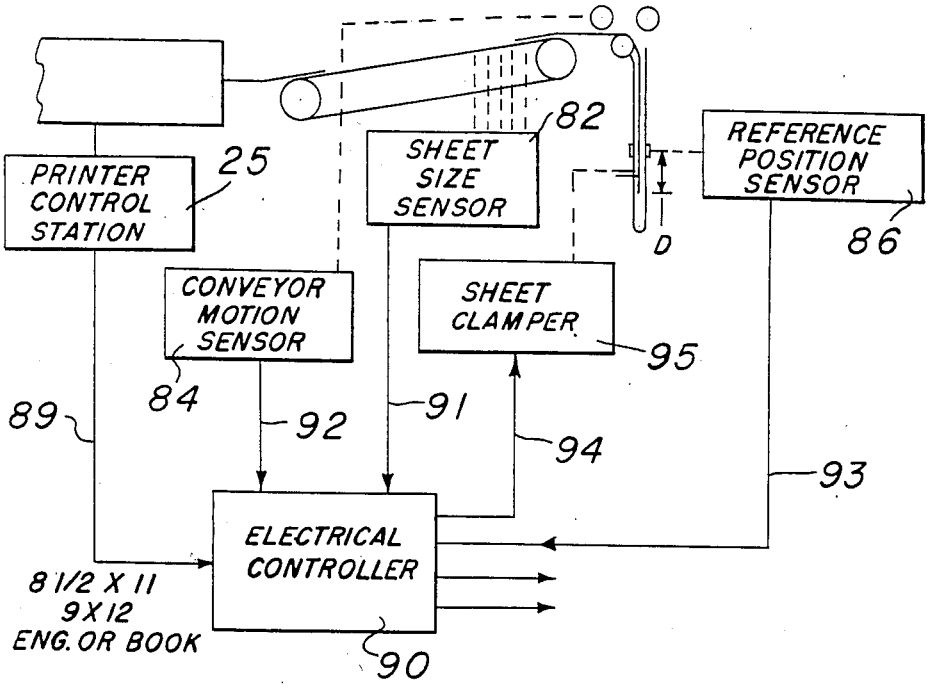
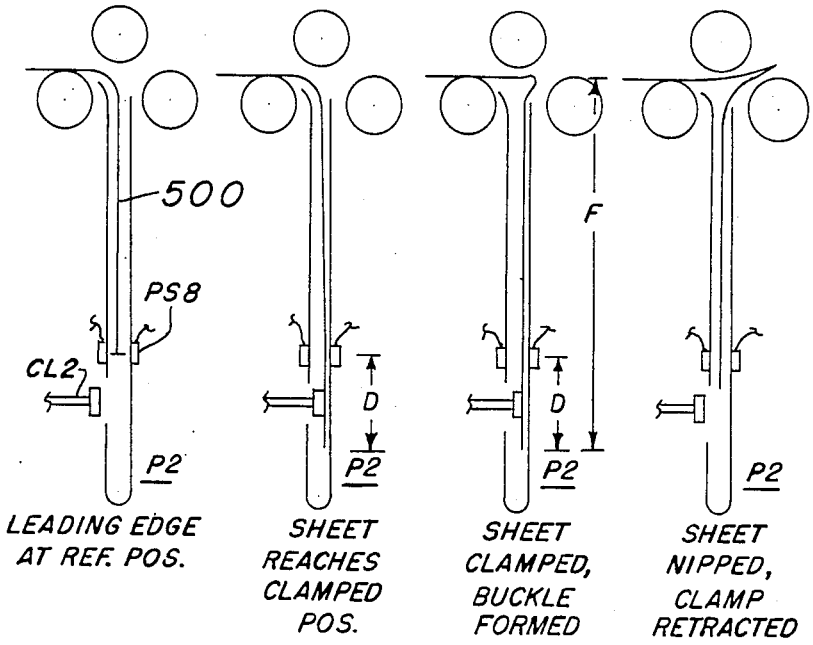
FIG. 17A FIG. 17B FIG. 17C FIG. 17D

BUCKLE CHUTE FOLDER WITH CLAMP

FIELD OF THE INVENTION

This invention relates to method and apparatus for folding sheets of material, and particularly to such method and apparatus for folding successive sheets of material along fold lines differently located with respect to the leading edge of a sheet as it passes along a conveyor.

BACKGROUND OF THE INVENTION

Folding machines are known in which successive sheets to be folded, for example blueprints or the like, move in a series train along a conveyor so that the leading edge of each sheet is passed into a pocket extending at an angle to the conveyor line, until its leading edge is arrested by a bottom stop in the pocket; such arresting then determines the position of a fold line produced in the sheet. The folding may typically be produced by a buckle folding arrangement in which the stoppage of the leading edge of the sheet causes a buckling of the sheet to occur at a predetermined position, and rollers crease the buckled area into a completed fold. Prior folder systems are described, for example, in U.S. Pat. No. 3,052,464, of Rudolph Funk, issued September 4, 1962 and entitled Apparatus For Folding Flexible Sheets; U.S. Pat. No. 3,117,777 of Rudolph Funk, issued January 14, 1964 and entitled Apparatus for Cross Folding Flexible Sheets; U.S. Pat. No. 3,698,705 of Rudolph Funk and Roger S. Funk, issued October 17, 1972 and entitled Apparatus For Folding Flexible Sheets; and U.S. Pat. No. 3,961,781 of Roger S. Funk, issued June 8, 1976 and entitled Foldable-Sheet Processing Systems. It is noted that it is possible to effect the folding by means of a blade device, rather than a buckling arrangement, once the leading edge of the material has been arrested in the pocket. After the sheet passes through the first set of crease-producing rollers, it may be folded one or more additional times along the same direction, and it may also be folded by a similar arrangement acting at right angles to the original folds, whereby an original sheet may be multiply folded into a relatively small packet or book.

When the fold lines are to be produced at the same relative positions with respect to the leading edges of the sheets for all successive sheets, the stops in the various pockets need only be maintained in a desired fixed position to effect the desired folding. It is also possible to provide adjustability of the position of the stops in the pockets, so that the stops can be moved toward or away from the entrance end of the pocket to produce folding at any desired position when different folding routines are to be performed, for example for different size sheets.

This latter procedure is relatively easy and suitable when long runs of identical sheets are to be folded in the same manner. The stops can be set up manually in a suitable manner for a given run, and after that run is completed they can, if necessary, be adjusted to different positions for another size of sheet. In such cases the fact that it requires a substantial amount of time and effort to effect manual adjustment is not a major deterrent to successful efficient operation.

However, when the runs of the same type of sheet to be folded in the same way are short, or where in fact each successive sheet may have any of a variety of differing fold requirements because of its size and desired folding pattern, then some automatic means for providing these changes in folding pattern become highly desirable.

Accordingly, it is an object of the present invention to provide a new and useful method and apparatus for controlling the folding of sheets of material.

Another object is to provide such method and apparatus which will automatically provide suitably different folding patterns for different sheets, particularly sheets of different sizes.

A further object is to provide such method and apparatus which are capable of producing rapid, automatic, and fine adjustment of the point at which a sheet is arrested in its advance into a pocket.

A still further object is to provide such apparatus which is reliable, compact, and highly versatile.

SUMMARY OF THE INVENTION

These and other objects of the invention are achieved by the provision of a new method and apparatus for folding sheet material, of the type in which the leading edges of the successive sheets moving along a conveyor are advanced into a sheet-receiving pocket and arrested at a controllable position within the pocket, at which time folding means operate upon the arrested sheet to produce a fold line in a desired position determined by how far the sheet has advanced into the pocket. In accordance with the invention, the sheet-arresting means comprises sheet-clamping means positioned adjacent to the pocket and actuatable to clamp the sheet with respect to the pocket and thereby arrest its advance into the pocket, together with control means for controlling the sheet position at which the clamping means is actuated, thereby to control the position at which the sheet is arrested and therefore the position on the sheet of the fold line made by the folding means.

Preferably the system includes means for sensing from the sheet itself, for example from its size, the position at which one or more folds are to be made, and the sheet position at which the clamping means is actuated is controlled at least partially in response to signals from such sensing means. In a preferred embodiment, the size of each sheet is sensed prior to its entrance into the pocket; the time at which the leading edge of the sheet arrives at a predetermined reference position at the pocket is also sensed; and a control circuit operates in response to signals from the two sensing means to operate the clamping means when the folder conveyor has advanced the sheet into the pocket to the position at which folding is desired. This may be accomplished, for example, by using a proximity sensor adjacent a gear on the folder motor shaft to produce an electrical pulse each time the conveyor moves by a predetermined amount, counting the number of such pulses which occur after the sheet has reached the predetermined reference position, and actuating the clamping means when a predetermined number of such pulses have occurred.

A preferred embodiment employs clamping means which comprise electrically actuatable solenoid means, acting perpendicular to the pocket in the region occupied by the sheet when it is advanced into the pocket to the desired position; preferably a plurality of clamping elements are used, spaced apart across the width of the pocket so as to provide clamping at a number of different lateral positions.

A plurality of such folding pocket assemblies may be provided along the conveyor to provide both parallel folding (parallel to the leading edge) and cross folding (perpendicular to the leading edge), and the control means may be arranged so that, for each size of sheet material, a predetermined sequence of parallel and/or cross folds will be produced at determined positions on the print, so as to produce the final desired packet or book for that size of sheet.

BRIEF DESCRIPTION OF THE INVENTION

These and other objects and features of the invention will be more readily understood from a consideration of the following detailed description, taken with the accompanying drawings, in which.

Figure 1:
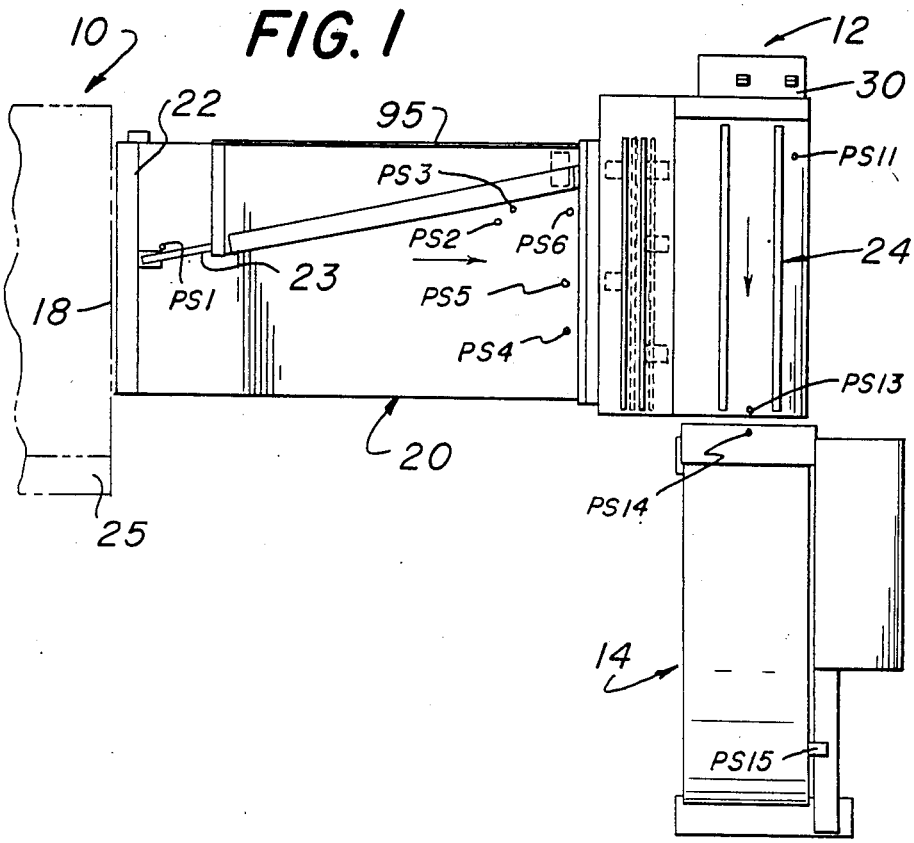
FIG. 1 is a schematic plan view of a system in which the folder of the invention is used, showing the folder, together with the output end of a printer supplying the folder with sheets, and a collator to which the folded sheets are supplied by the output of the folder.
Figure 2:
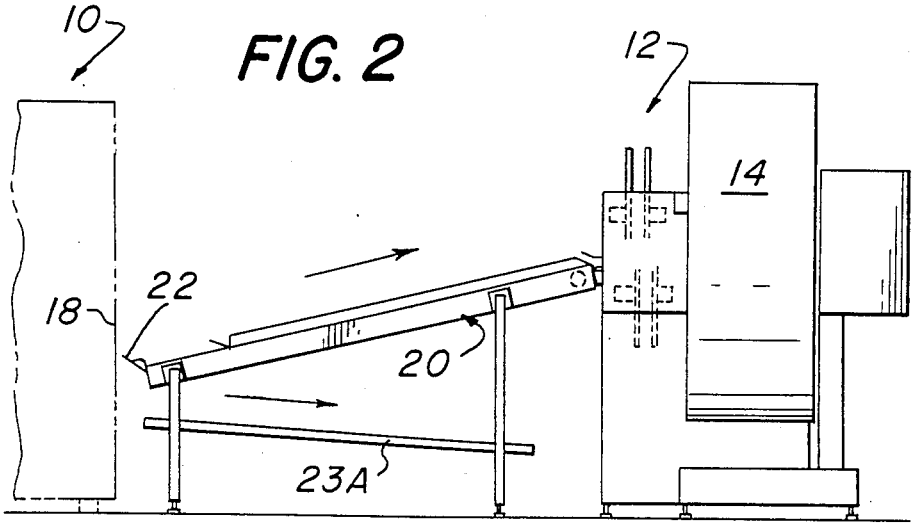
FIG. 2 is a schematic front elevation view of the apparatus of FIG. 1.
Figure 3A:
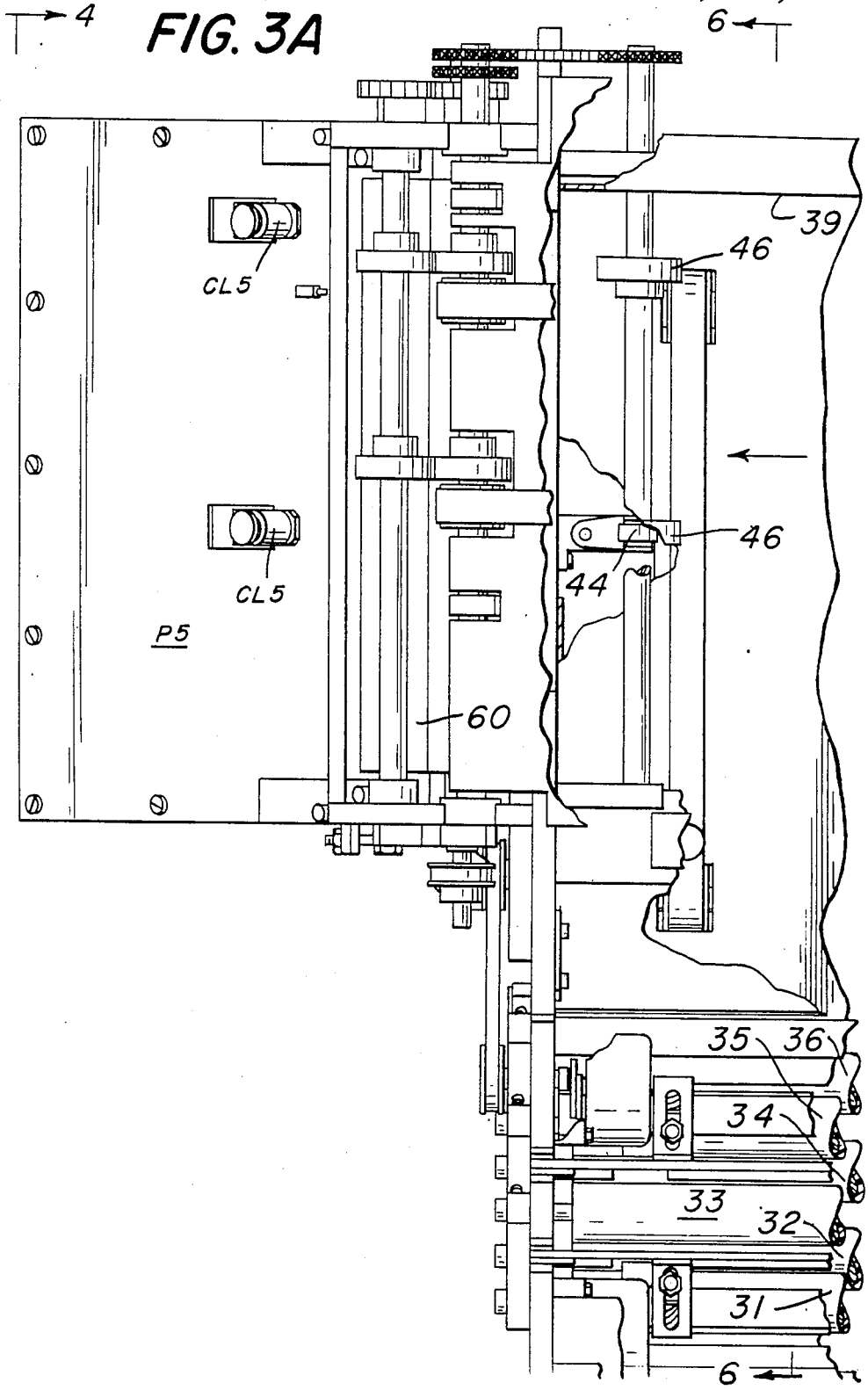
Figure 3B:
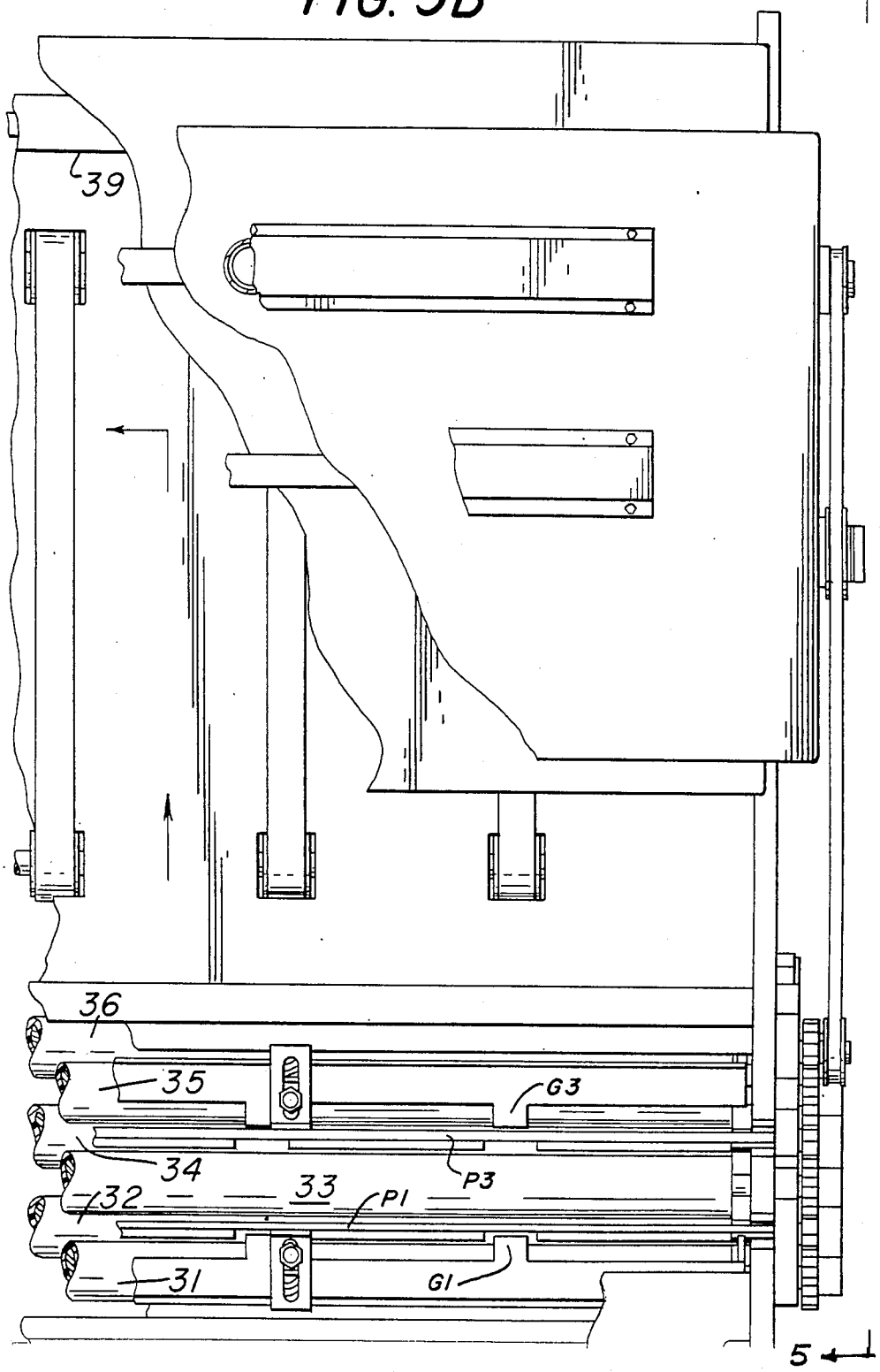
Figure 4:
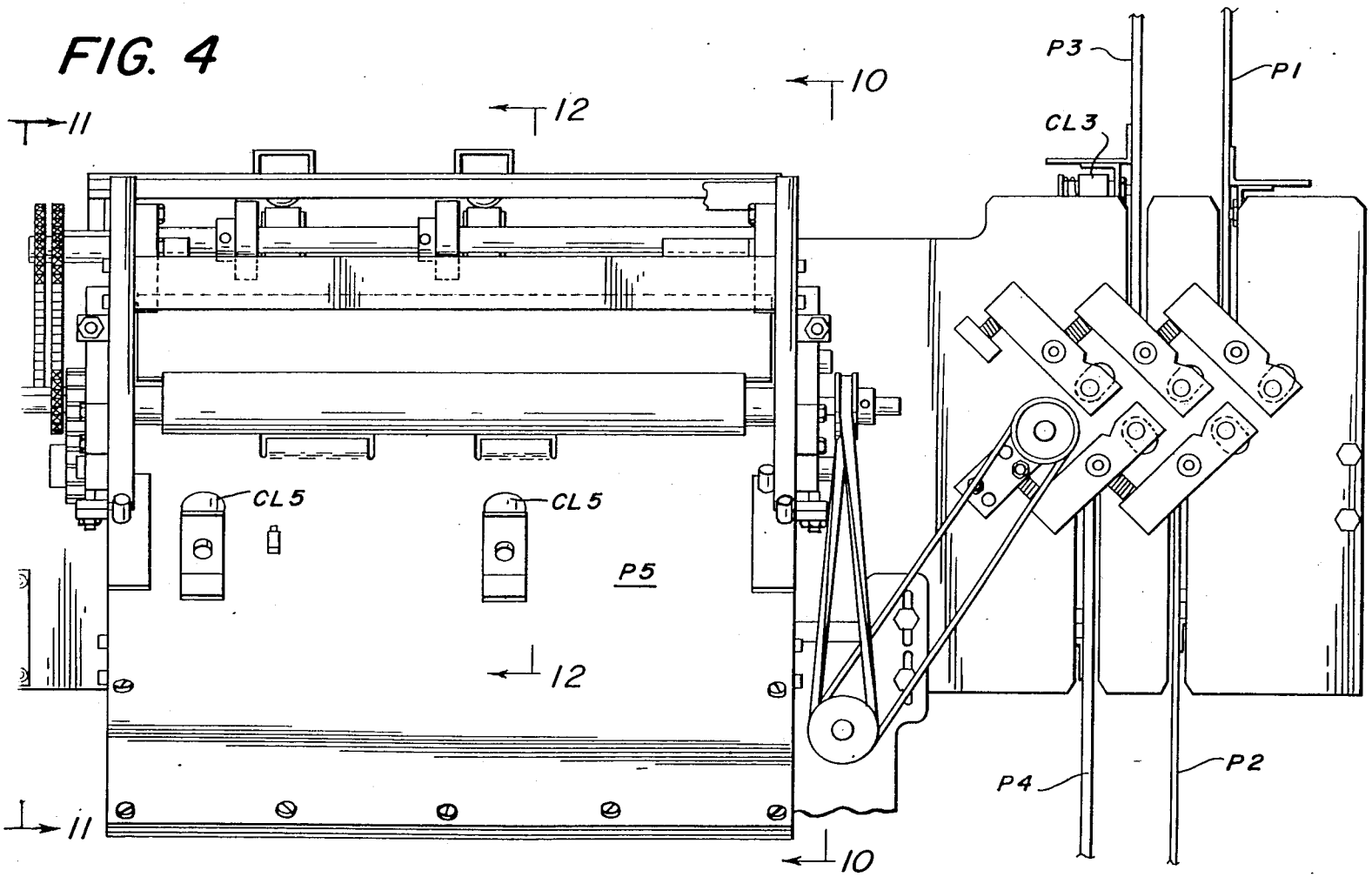
Figure 5:
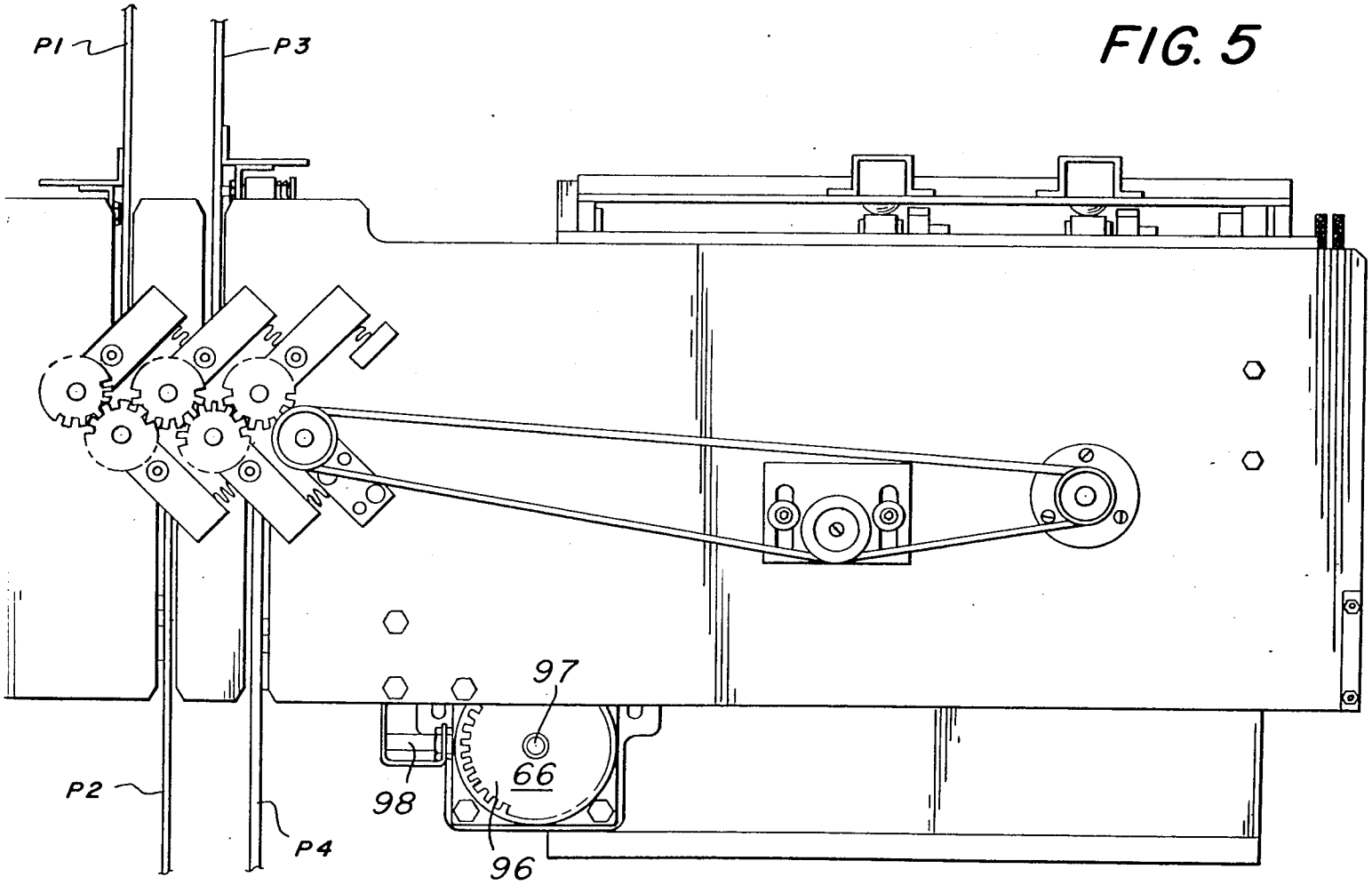
Figure 6:
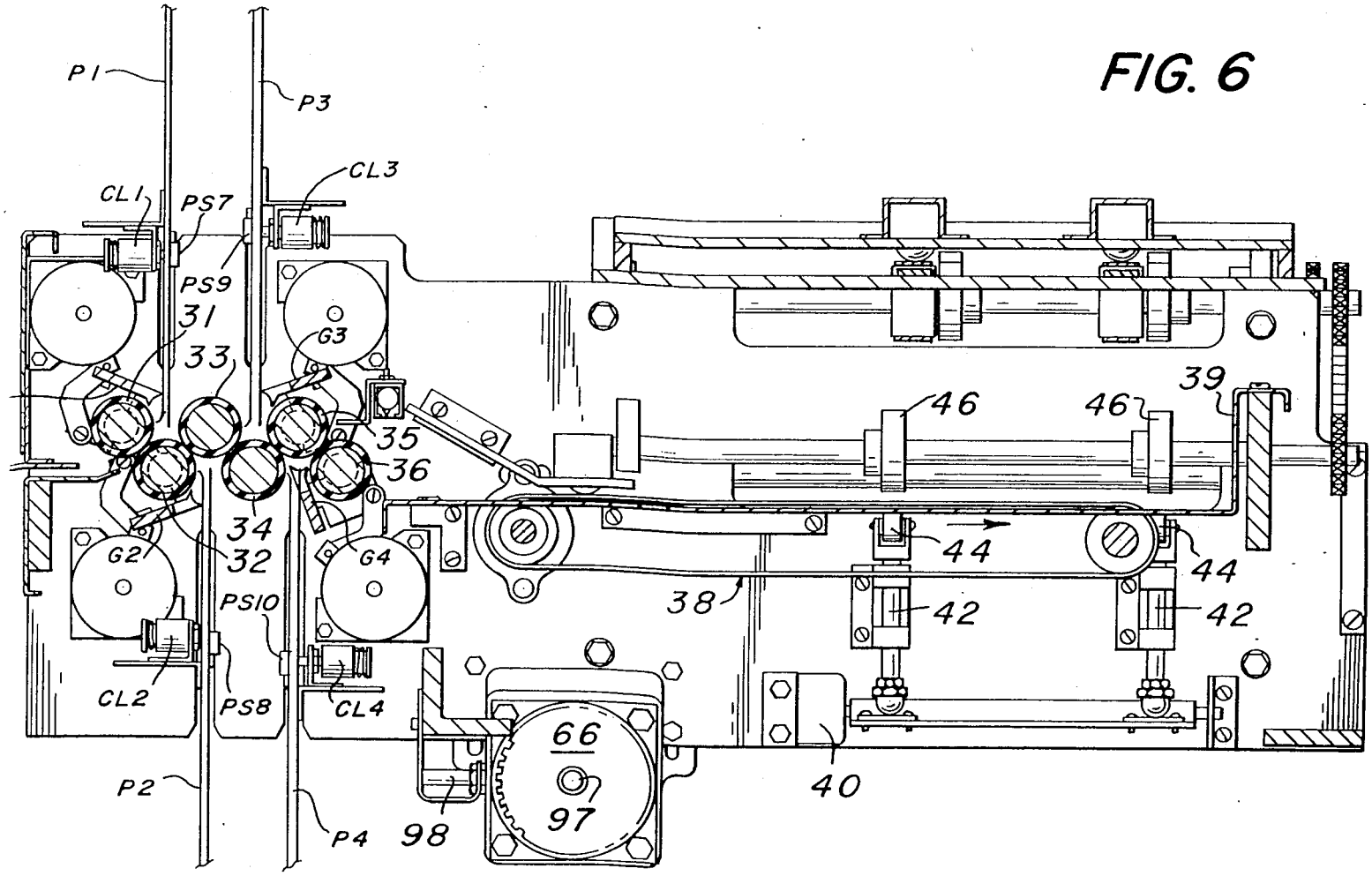
Figure 7:
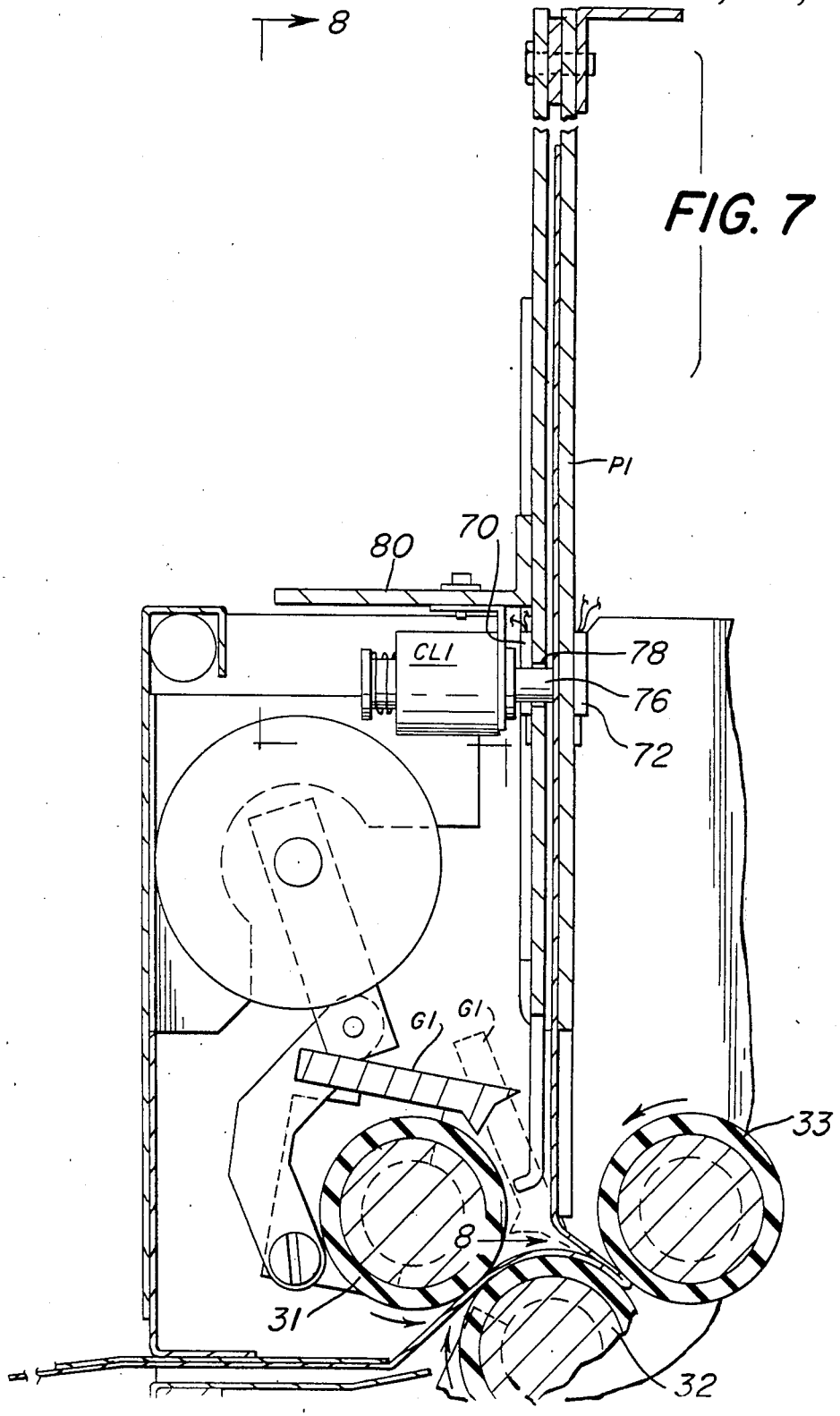
Figure 8:
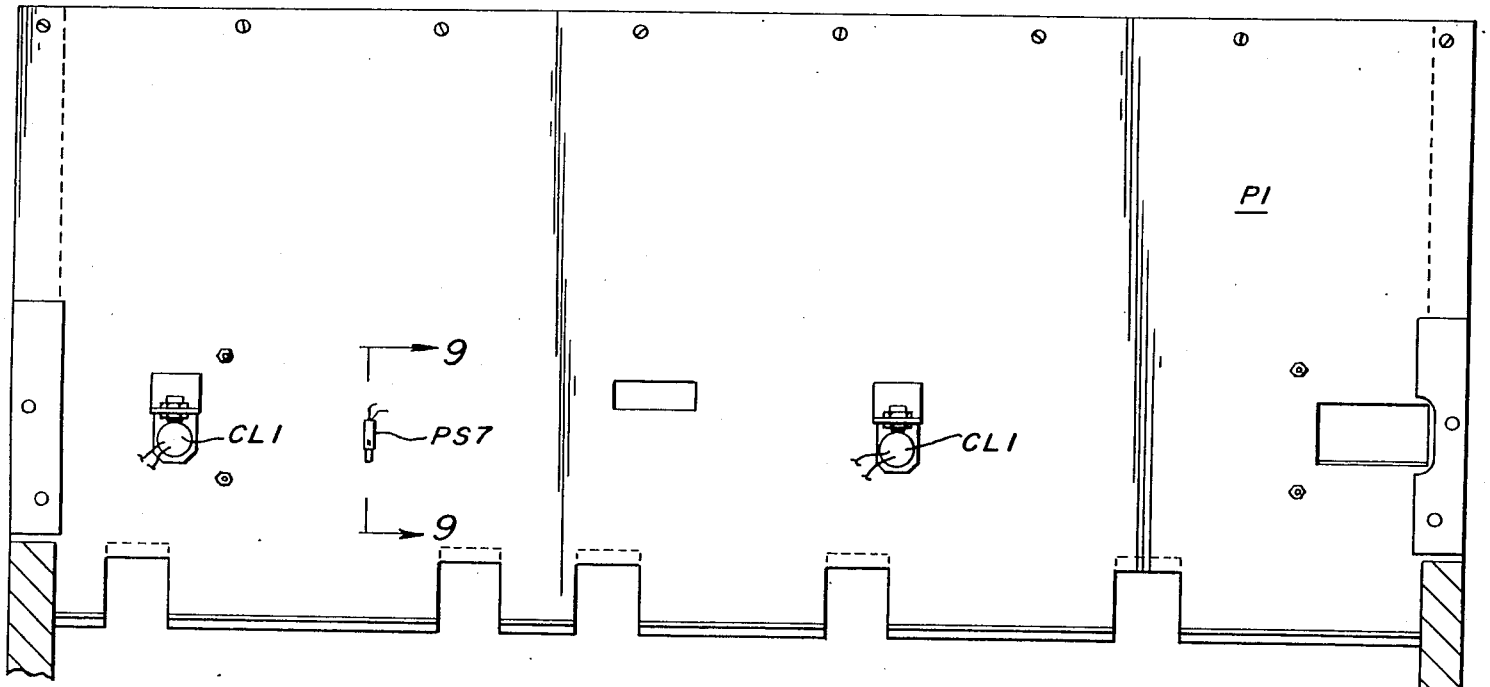
Figure 9:
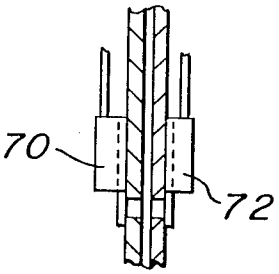
Figure 10:
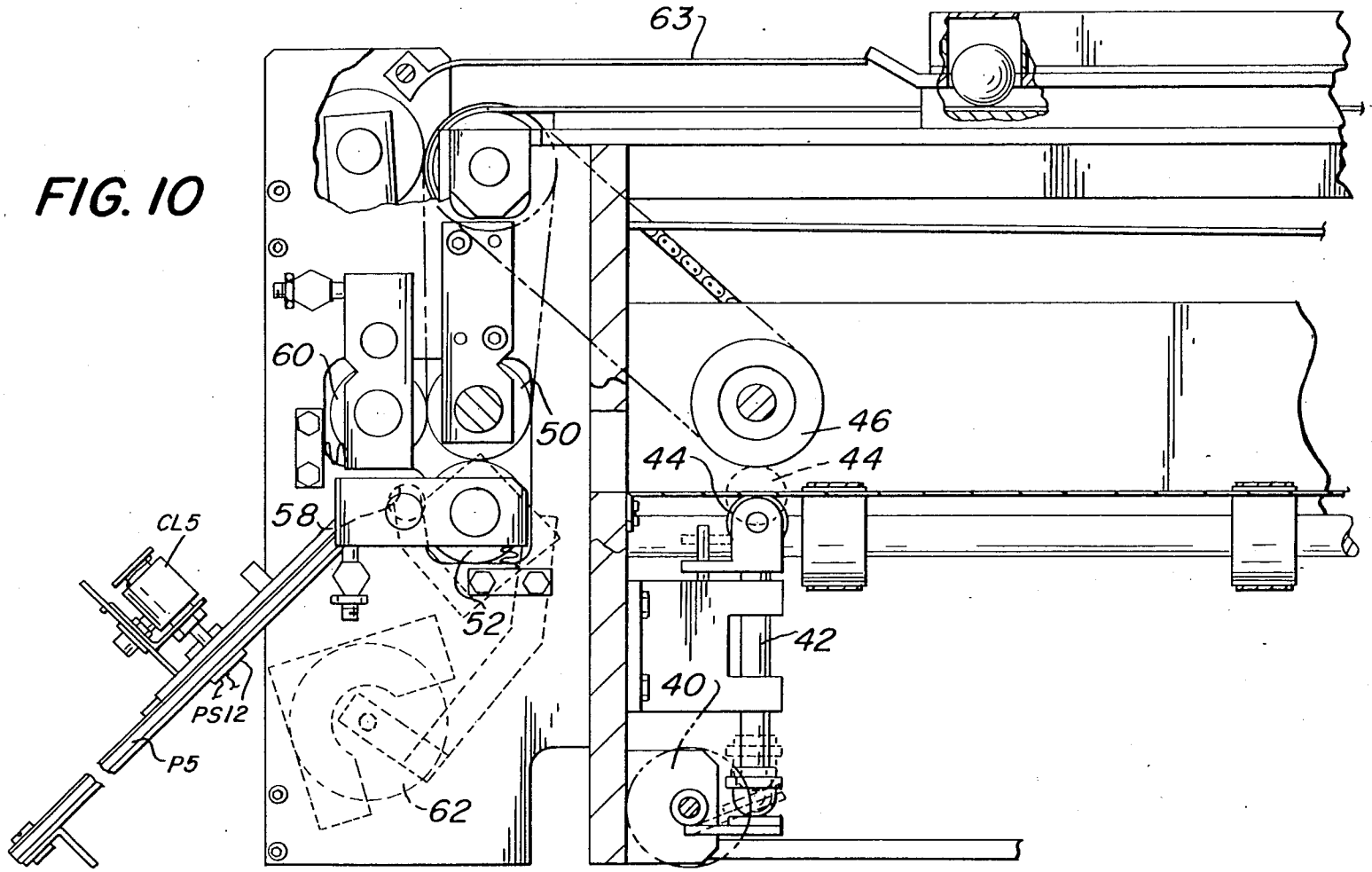
Figure 11:
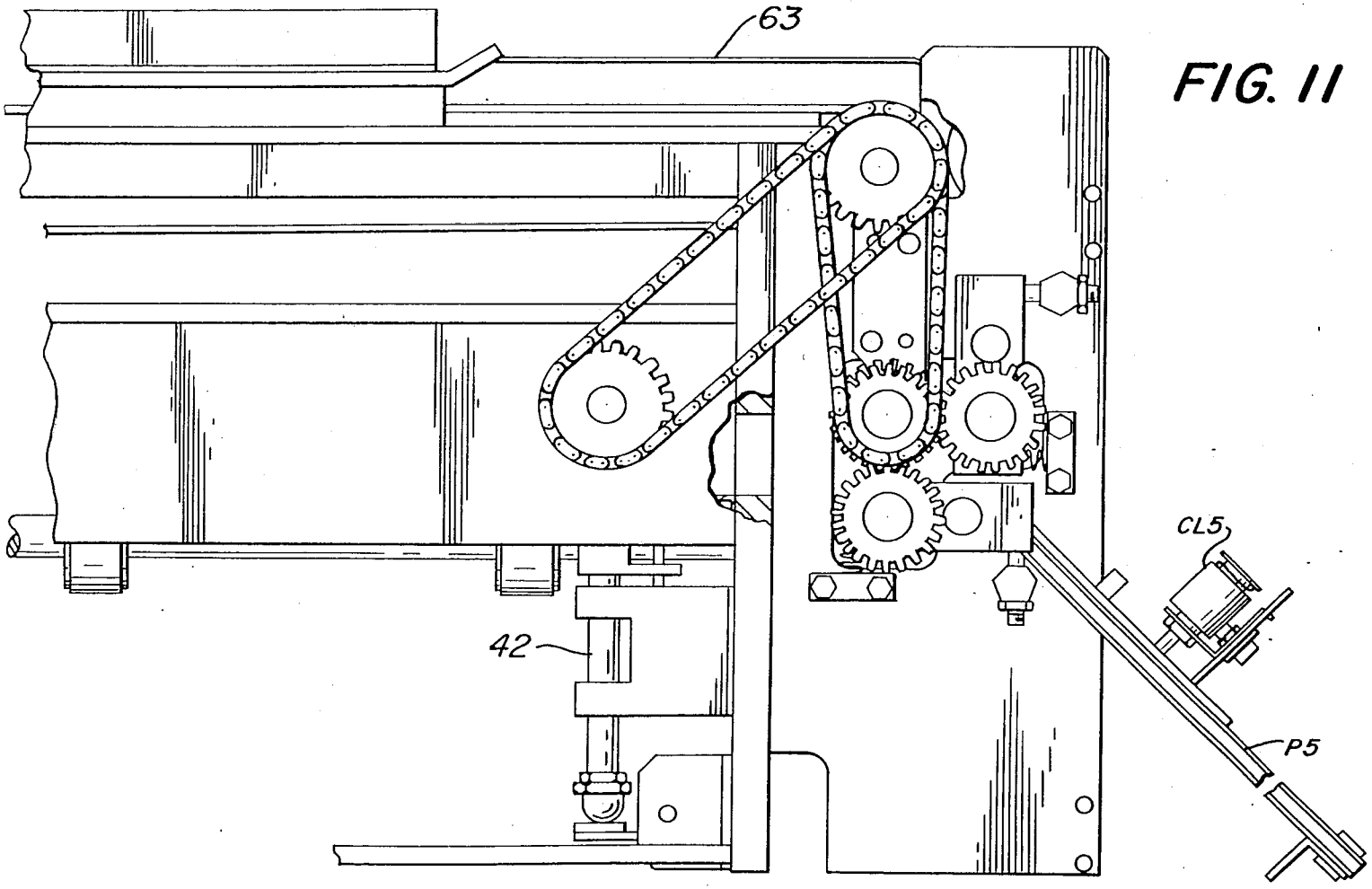
Figure 12:
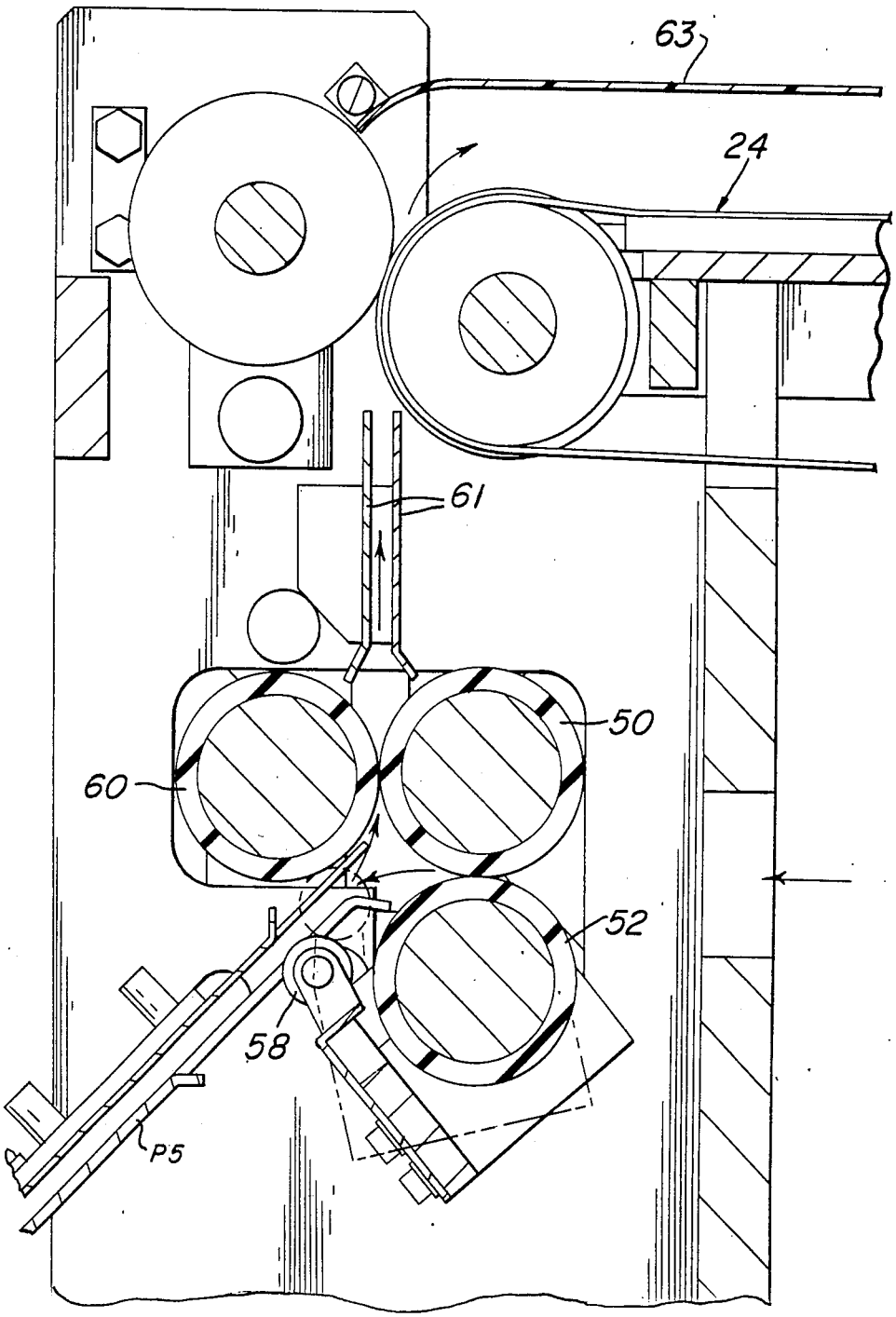
Figure 14:
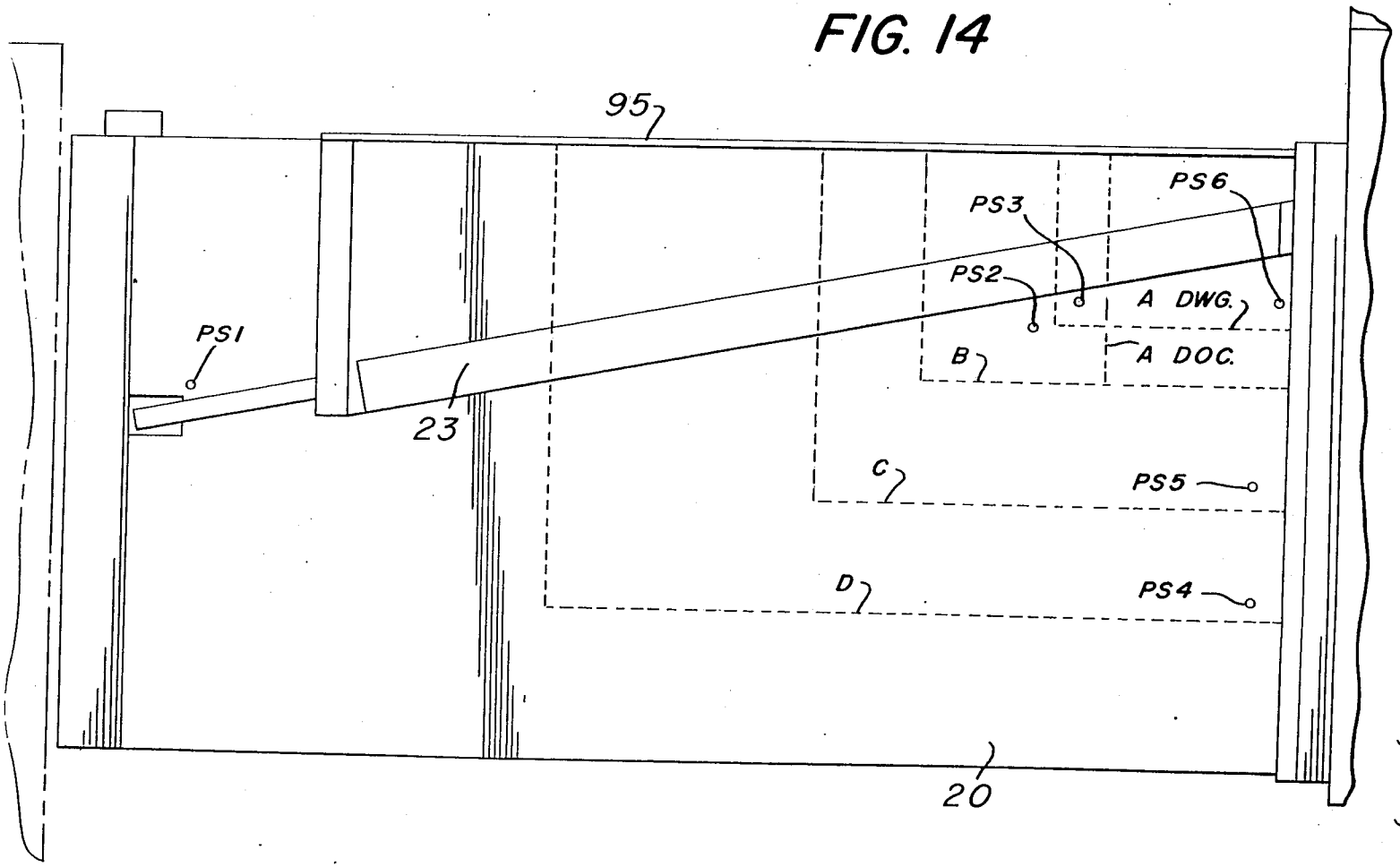
Figure 16:
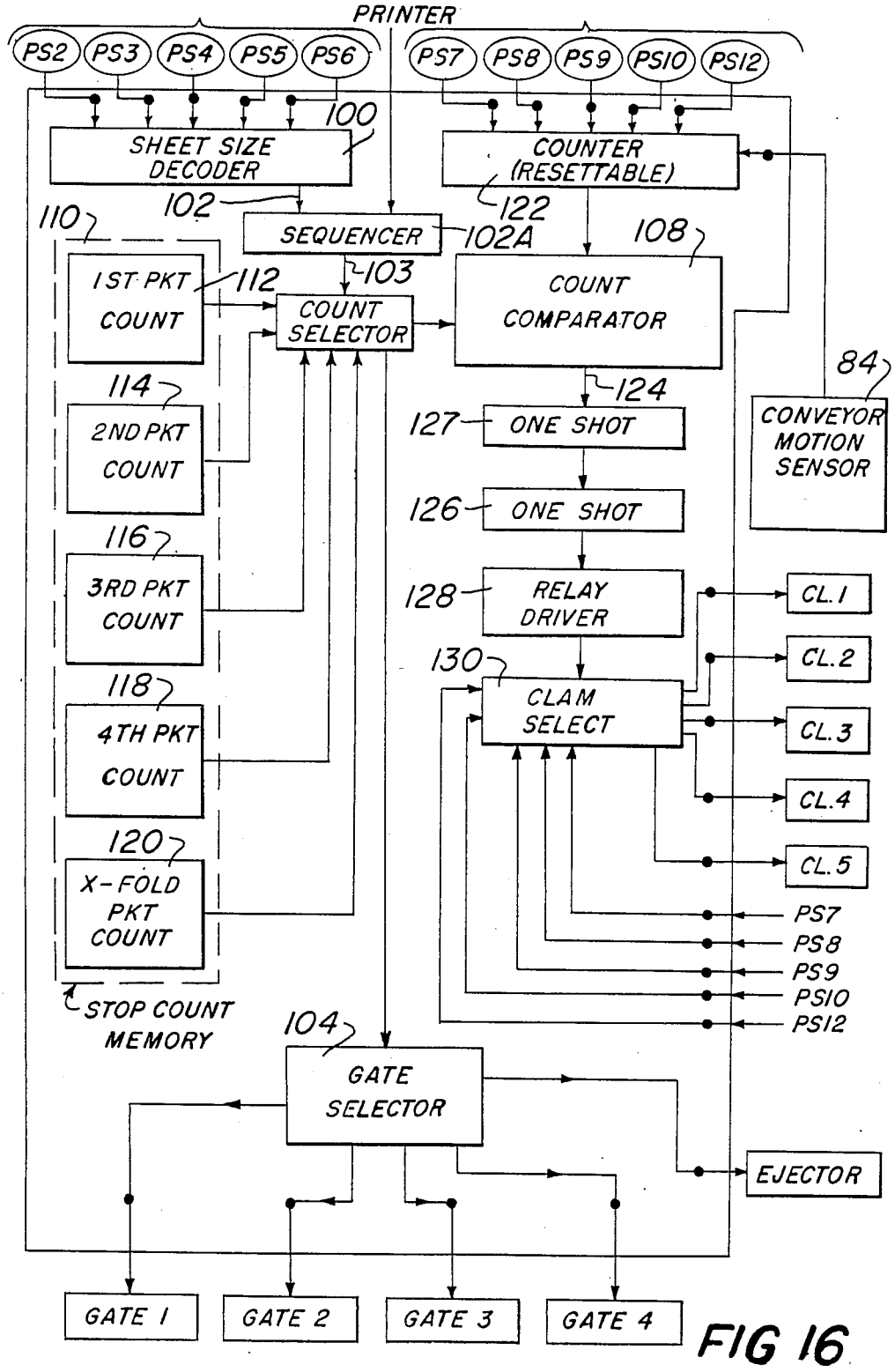
Figure 18:
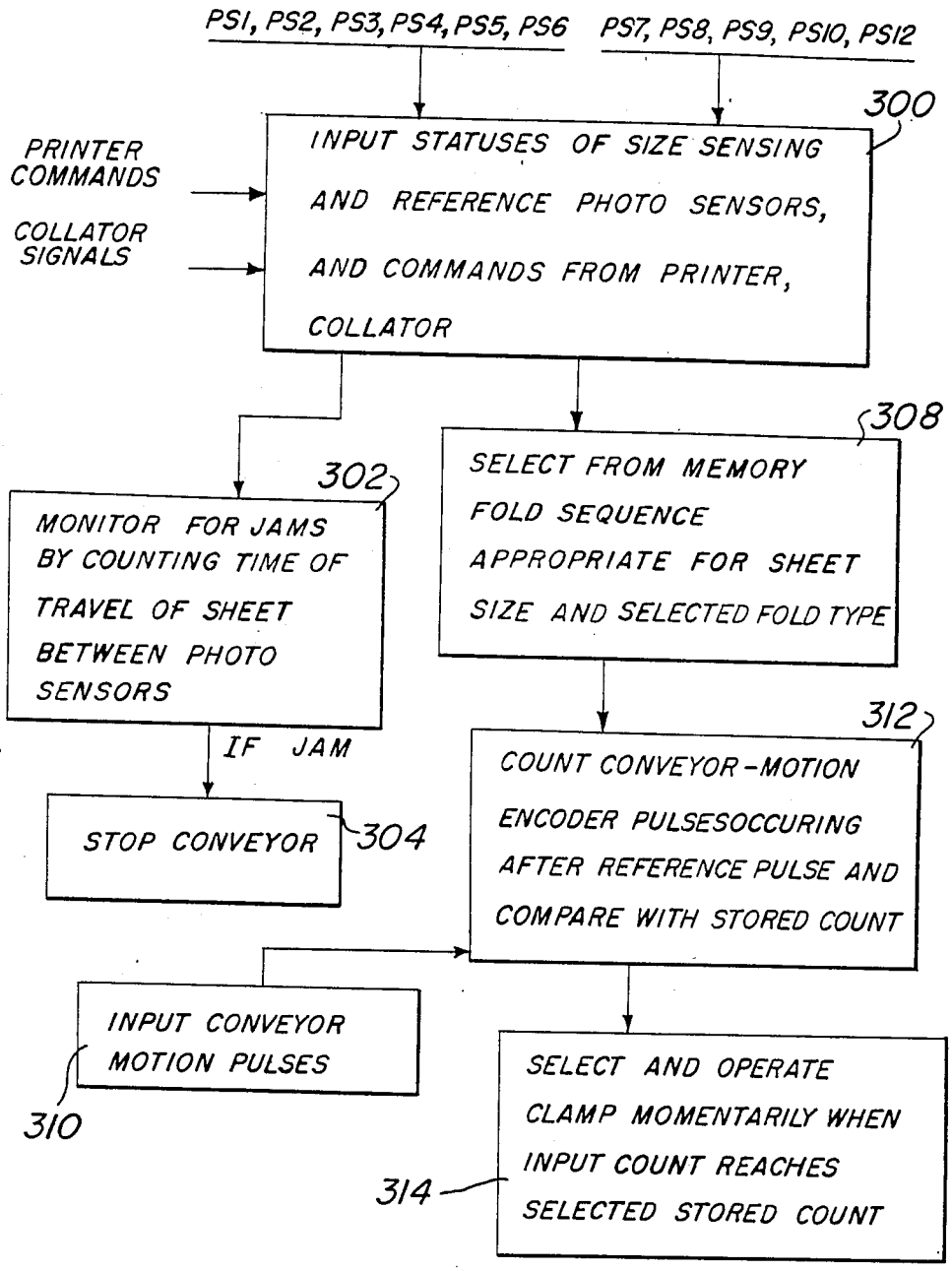
Figure 19:
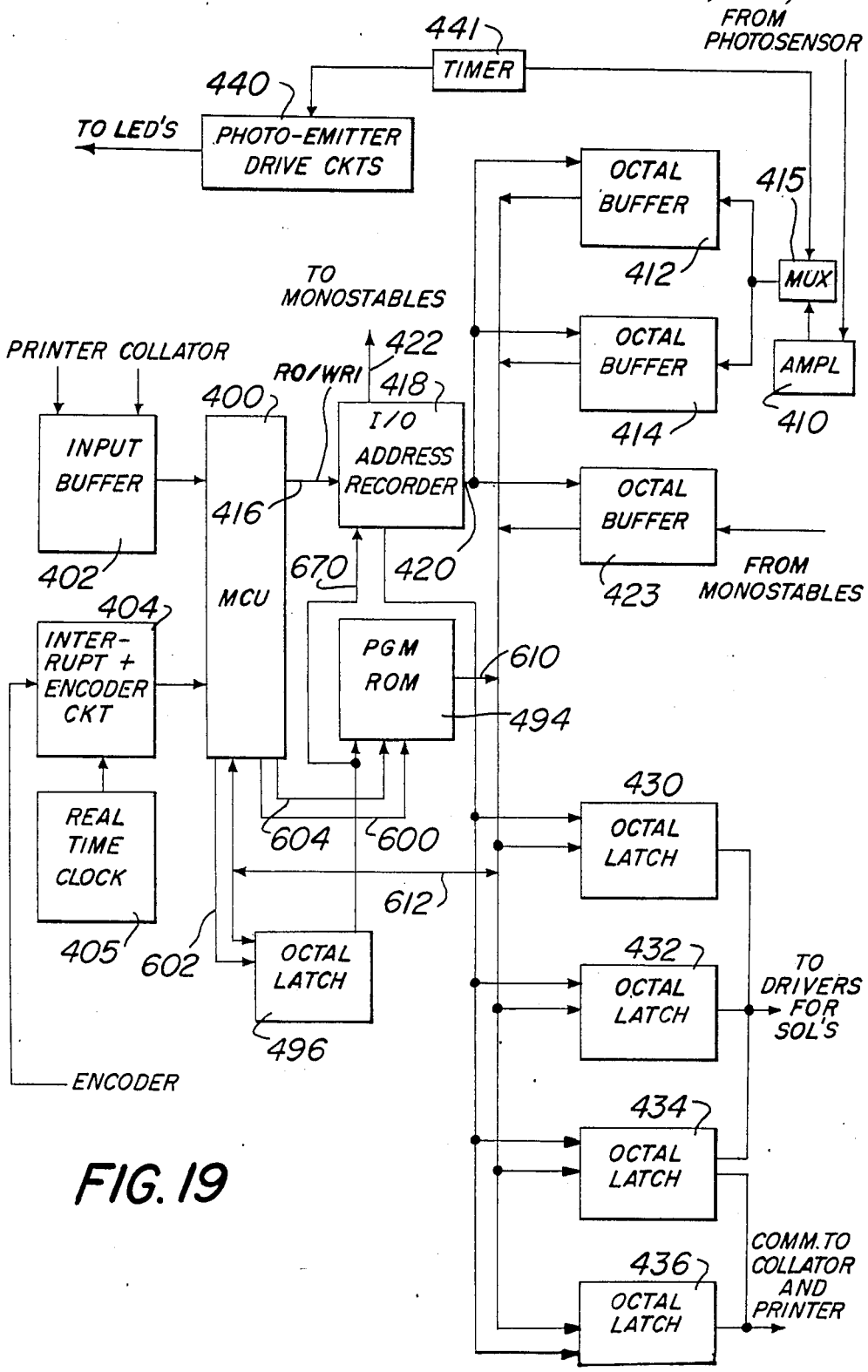

FIGS. 3A and 3B taken together constitute a more detailed plan view of the folder of FIG. 1;

FIG. 4 is a rear view of the folder of FIG. 3A;

FIG. 5 is a front view of the folder of FIG. 3B;

FIG. 6 a vertical section, partly in full, taken along lines 6—6 of FIG. 3A;

FIG. 7 is an enlarged fragmentary vertical sectional view showing the first pocket and associated rollers and gates at the time when folding of a sheet is beginning;

FIG. 8 is an elevational view of the first pocket, taken along lines 8—8 of FIG. 7;

FIG. 9 is an enlarged fragmentary sectional view taken along lines 9—9 of FIG. 8, showing details of a reference sensor;

FIG. 10 is a vertical sectional view, taken along lines 10—10 of FIG. 4;

FIG. 11 is an end view of the folder, taken along lines 11—11 of FIG. 4;

FIG. 12 is an enlarged fragmentary sectional view taken along lines 12—12 of FIG. 4, showing the cross-fold ejection mechanism;

FIGS. 13A–13D comprise sets of schematic diagrams illustrating how "A", "B", "C" and "D" size sheets are processed by the parallel folder illustrated, and showing also the corresponding gate positions; FIG. 13E a similar set of diagrams for the subsequent cross-folding operation;

FIG. 14 is an enlarged plan view of the feeder input conveyor of FIG. 1, showing how A-DOC, A-DWG, B, C and D size sheets are sensed;

FIG. 15 is a generalized schematic diagram of an electrical system for controlling the folder;

FIG. 16 is a more detailed block diagram of a preferred electrical control system for the folder;

FIGS. 17A, B, C and D are schematic diagrams of a typical pocket, illustrating operations in accordance with the invention;

FIG. 18 is a broad flow chart showing the steps involved in the operation of the invention in one form; and FIG. 19 is a schematic diagram of a preferred microcomputer system used in a preferred form of the invention.

DETAILED DESCRIPTION OF SPECIFIC EMBODIMENTS

Referring now to the preferred embodiment of the invention shown in the drawings by way of example only, and without thereby in any way limiting the scope of the invention, FIG. 1 shows a combination of printer 10, folder 12 and collator 14 in connection with which the invention may be used advantageously. The printer may operate by any printing principle, since the present invention is concerned with the folding of the sheets of paper on which the printing occurs and not with the subject matter or nature of the printing itself.

The output end 18 of the printer 10 delivers the sheets in a spaced-apart series train onto the folder input conveyor 20, with the sheets oriented in a known manner. For example, all sheets may be delivered onto this conveyor with the printed matter on the top side thereof; $8\frac{1}{2}''\times 11''$ sheets may be presented in either the "document" ("portrait") orientation with respect to the direction of motion on the conveyor, or in the so-called "drawing" ("landscape") orientation. Other sheets, in this example, will comprise so-called B, C or D size sheets having respective dimensions of $11''\times 17''$, $17''\times 22''$ and $22''\times 34''$. It will be understood that the system may be, and preferably is, designed to handle sheets differing from the above, for example sheets having dimensions which are multiples of $9''\times 12''$ rather than of $8\frac{1}{2}\times 11''$; in addition, European sheet sizes may be accommodated in such a machine, in which the so-called A-4 sheet is the basic size sheet and the other sheets are so-called A-3, A-2 and A-1 sheets. In this preferred embodiment, a solenoid-operated diverter 22 is provided just ahead of the folder input conveyor, which in the event of a jam of sheets in the folder may be automatically pivoted upwardly to divert the printer output sheets to a lower table 23A until the jam can be corrected.

As in comparable machines of the prior art, the sheets are conveyed along the top of the folder input conveyor by an overlying high-friction belt 23, into the folder 12. The belt is diagonally arranged as shown, to move the corresponding edges of all sheets into alignment against a guide wall 95 at the edge of the input conveyor. In the folder, each sheet is provided with the requisite number of folds, in this example up to four parallel folds and one cross-fold. In this example, the sheets exit from the folder along a direction at right angles to the direction of motion of the folder input conveyor, and are delivered upwardly onto a upper conveyor 24 which in turn delivers them into the bins of a rotary type collator 14. It is, of course, possible to deliver the folded sheet materials to other types of devices, or merely onto a table on which manual sorting is accomplished. However, it is preferred that they be automatically delivered to a collator, preferably to the type of rotary collator described in copending U.S. patent application Ser. No. 019,070 of Kenneth A. Ore and Warren S. Frank, filed Feb. 16, 1987, entitled Sheet Distributing Method and Apparatus and of common assignee herewith.

At the printer 10 there will normally be a printer control station 25 (not shown in detail) which, in addition to certain indications of equipment status, preferably contains some command buttons; for example, in a preferred embodiment the operator at the printer may push a button indicating to the control apparatus that folding is to be based on an $8\frac{1}{2}''\times 11''$, rather than a $9''\times 12''$ ("oversized") basic sheet, or that a socalled "book" fold rather than a standard "engineering" fold of sheets is to be provided by the folder.

The control apparatus for the folder may be located in a suitable paneled cabinet 30 secured to the folder, and typically includes a circuit board, a transformer, and several relays and circuit breakers.

The present invention is concerned primarily with the control system for controlling the folder 12 to accomplish the desired types of folding. FIGS. 15, 16, 18 and 19 show this system in schematic form. Before describing the control system, it will be appropriate to describe in more detail the mechanical system employed in this preferred embodiment.

Referring especially to FIGS. 5 and 8, wherein the four parallel-fold pockets P1, P2, P3 and P4 are shown and pocket P1 is detailed, P1 is the first fold pocket encountered by the sheets in travelling through the folder, and is typical of the other pockets P2, P3 and P4. The pocket and its associated control mechanisms may be generally similar to those previously employed, with the important exception of the arrangement for arresting the sheet when it has entered the pocket.

As is usual in such devices, and as shown particularly clearly in FIGS. 6 and 7, the pockets have associated therewith a set of six rollers 31–36 arranged with respect to four solenoid controlled gates G1, G2, G3 and G4 so that, when a gate is actuated to rotate it to its closed position such as is shown in broken line in FIG. 7 for gate G1, the sheet or packet is prevented from entering the corresponding pocket and instead passes through between the rollers in a serpentine fashion, without being folded and without change, toward the next pocket, which it may or may not enter for folding, depending upon the condition of the associated gate, and so on for the other succeeding pockets.

When the gate G1 is deactuated to rotate it to its open position, shown in full line in FIG. 7, the leading edge of the sheet passes into the pocket P1, wherein it is ultimately arrested by the clamping device CL1 so that the portion thereof near the nip between rollers 32 and 33 buckles as shown; the buckled portion enters between the latter two rollers and is folded and creased as it is drawn through toward the next pocket. This general type of folding and creasing operation being well known in the art, it need not be described in further detail herein, with the important exception of the clamping arrangement.

As mentioned, this same operation of gates, rollers and pockets is provided for all of pockets P1, P2, P3 and P4, so that the sheet exiting from P4 may have no folds or up to four parallel folds depending upon the gate positions at each of the four pockets as it is delivered to the longitudinal conveyor 38 (FIG. 6).

In this example, a cross folder is also provided which receives the sheet as it emerges from the parallel fold section, folded or unfolded, arrests its motion by abutment against end wall or stop 39 (see FIG. 3A) whereupon by actuation of rotary solenoid 40 (FIGS. 6 and 10) plungers 42 are moved upwardly and transversely to the longitudinal direction of conveying so as to move the rollers 44 against rollers 46 (FIG. 10). This causes the sheet to be conveyed transversely, between rollers such as 44 and 46, whereby the sheet or semi-packet (a pocket which has not yet been cross-folded) is caused to be conveyed at right angles to the previous longitudinal conveying path. From this position, the leading edge of the sheet or packet is fed into the pocket P5 for cross-folding, or for ejection in reversed position without folding, by rollers 50 and 52.

Pocket P5 has no gate but otherwise operates generally similarly to the other pockets and need not be further described, with the exception of the ejector mechanism associated with it.

The printer delivers all prints face-up and centered on the conveyor so that they read properly if viewed from the guide-wall side of the input conveyor, e.g. the "legend" area of engineering drawings appears at the lower right as usual, except for A-DOC prints which are delivered onto the input conveyor with the "legend" area at the top right as viewed from the guide wall. All prints are delivered to the upper conveyor 24 at the output of the folder print-side up, and oriented so that the legend area is in the same position when viewed along the direction of motion of the upper conveyor as when viewed from the guide-wall side of the input conveyor.

All sheets enter the cross-folder, but only those greater than B-size (or A-3) require folding therein. The unfolded A-size drawings and the already-folded B-size drawings enter the cross-fold pocket completely, so that there is no buckling and hence no folding. If instead they were caused to bypass the cross-folder, as by operation of a gate for example, they would arrive at the upper conveyor reversed (legend side down). Operation of the ejector overcomes this difficulty by, in effect, grasping the upper end of the A and B size sheets, pulling them out of the pocket, and delivering them reversed, onto the top conveyor in the proper orientation, print-side up.

The ejector operates as follows. In the event that the cross-folder is to be controlled so that folding does not occur in it, but reversal by the ejector is desired, the clamping system CL5 (FIG. 10) permits the sheet or packet to advance into the pocket P5 to its full length, so that no buckling or folding occurs; as shown in FIG. 12, an ejector solenoid 62 is then operated to pivot the ejector roller 58, which is normally in the non-contacting position shown in full line, into position against driven roller 60 as shown in broken line, whereby it holds the upper end of the sheet against roller 60 so that the sheet or packet is thereby removed from pocket P5 in a reversed position with respect to the side which is presented upwardly, as desired to place it in the proper orientation on upper conveyor 24. Operation of the ejector roller to and from its operative position is produced by rotary solenoid 62 under control of the folder controller circuit.

In this embodiment, the sheets and packets from the cross folder 12 (FIG. 12) are delivered by the rollers upwardly between plates 61 onto the upper conveyor 24 on which they are carried to the input to the rotary collator 14. A top guide plate 63 extends horizontally above the conveyor to hold the sheets in place on the conveyor. The collator in this example, consists of conventional radial bins, typically twenty-five in number, each with a corresponding entry slot facing the end of the top conveyor. The collator is controlled so that it is in an appropriate stopped position, with an entry slot facing the output of the upper conveyor belt, each time it is to receive a sheet, so that the sheet can be properly delivered through the appropriate entry slot into the bin.

In overall operation, then, a sheet from the printer 10 is fed by the input conveyor 20 into folder 12 and passes through the six rollers adjacent the open ends of the four pockets P1-P4; P1 and P3 extend diagonally upwardly, and P2 and P4 extend diagonally downwardly, as shown. Depending on the gate settings, each sheet passes into a pocket and is folded, or does not enter and is not folded in that pocket. At the end of the longitudinal run of the sheet, it is stopped by end wall 39 and picked up by rollers 50,52 so as to be moved transversely into cross-fold pocket P5, wherein it is either cross-folded or merely ejected in reversed position, as described above. The sheet then moves from the cross-folder upward onto upper conveyor 24 and then into collator 14.

The conveyors and rollers moving the sheets through the folder are all driven from, and in synchronism with, a common main-drive motor 66 (FIG. 5), by means of appropriate gears, belts, sprockets and chains, all as shown and as is known in the art for such types of apparatus.

Referring now to FIGS. 13A to 13D, the gate positions for parallel folding of A, B, C and D size sheets are shown by way of example; all but the A and B-size sheets are subsequently folded in half by the cross-folder, as shown in FIG. 13E. At the left in FIG. 13 are shown the positions of the desired fold lines, at the center are shown the appropriate gate positions and at the right are shown the resulting folds, prior to any cross-folding in FIG. 13E. As will be seen in FIG. 13A, an "A" size sheet is not to be folded, and therefore passes through without entering any of pockets P1-P4 (although as mentioned above, it enters P5 where it is ejected in reversed position, not folded). As shown in FIG. 13B, a "B" size print enters P2 and is folded longitudinally only once. As shown in FIG. 13C, a "C" size sheet enters P2 only and is parallelly folded only once (and once again in the cross-folder). As shown in FIG. 13D, a "D" size sheet enters P2, P3 and P4 (and is also cross-folded); it is understood that the three sets of rollers shown in FIG. 13D are the same set of 6 rollers, with the sheet shown in three different successive positions as it passes through them.

A more complete exposition of the gate positions and ejector condition for various sizes of sheets is shown in Table I, for both the engineering type of fold and the book type of fold, as well as for the DIN European fold. In that Table, opposite each listing of each size are X's indicating that the gate in that column is to be moved to its closed position so as to permit the sheet to pass the corresponding pocket without being folded, while a dash in the GATE column indicates that the gate is to remain open to produce no fold. Also shown under the heading "STOP" are the distances in inches which the sheet advances into the pocket; a dash again indicates that the sheet does not enter the pocket at all. The last column indicates by X those print sizes for which the ejector is actuated.

Referring now especially to FIGS. 8 and 9 and particularly to the arrangement of reference sensors and clamping apparatus shown therein, it is noted that pocket P1, like the other pockets, has associated therewith a photosensor designated as PS7, which senses when there is paper in the pocket at the position of the photosensor, and when there is not. As more particularly shown in FIG. 9, the photosensor in this example preferably constitutes a commercial unit consisting of an LED (light-emitting diode) light source 70 and a light detector 72 on the opposite side of the pocket from the light source, with the light from source 70 being directed toward the sensitive area of detector 72. When the paper is absent, current flows in the light-detector and indicates the absence-of-paper condition; when the paper is present between the light source and the light-detector, the current terminates and indicates the presence of paper.

Also mounted on the side of the pocket P1 are clamping means CL1 in the form of a set of two solenoid-operated clamps spaced apart from each other across the width of the pocket along a horizontal straight line, although other numbers of such clamps in other positions may be utilized. Clamps CL1 are spring-biased so that the solenoid piston 76 is normally retracted out of the pocket, but upon application of current to the solenoid the piston is moved rapidly outward, to extend through the corresponding opening such as 78 in the side of the pocket and to immediately clamp the sheet against the opposite wall of the pocket, thereby arresting further advance of the sheet (see FIG. 7). Preferably the outer tip of the piston is covered with a smooth relatively soft plastic material, such as an elastomeric material, to provide good gripping of the paper. The solenoids for CL1 may be mounted on the side of the pocket by an appropriate bracket such as 80 (FIG. 7).

Very shortly after the clamping action is first exerted, the actuating current through the clamping solenoid is terminated and the piston therefore withdrawn. It will be understood that the clamping of the sheet produces the desired arresting of the advancing of the sheet into the pocket which produces sheet buckling at the rollers, and that it therefore determines the place at which a fold is produced in the sheet; since the buckled region of the sheet is picked up by the nip of the rollers, and pulling of the sheet out of the pocket by the rollers begins rather soon after arrest of the sheet, e.g. within about $\frac{1}{4}$ second, the clamping generally is released after only a very small interval of time, such as about 200 milliseconds, for example. Adjustment of the duration of the clamping will of course be made in accordance with the requirements of the particular application.

The manner in which the time of the occurrence of the clamping action is controlled will now be described generally with particular reference to FIG. 15. In this figure there is shown, in broad block-diagram form, a sheet-size sensor 82 for sensing the sizes of the sheets delivered to the input of the folder, a conveyor-motion sensor 84 for sensing the motion of the conveyor which delivers the sheets through the folder and into the pockets, a reference position sensor 86 (PS7–PS10 & PS12) which senses when the sheet has been advanced to a reference position within the pocket, and a printer control station 25 at the printer by which certain information is sent to and from the printer control station from the electrical controller 90 over line 89. Only one pocket is shown, but the clamping control system is essentially the same for all pockets.

The intelligence from the sheet-size sensor 82 indicative of the size of the sheets is applied over line 91 to electrical controller 90; signals indicative of the motion of the conveyor are applied over line 92 to electrical controller 90; and the time at which the sheet reaches the reference position is indicated by signals supplied over line 93 to the electrical controller. In response to these inputs, the electrical controller 90 controls the gates and the ejector according to Table I and supplies a clamping signal over line 94 to sheet clamper 95 to actuate it momentarily at the appropriate sheet position. Signals representing whether an engineering fold or a book fold is to be produced are supplied over line 89.

The sheet-size sensor 82 and the conveyor motion sensor 84 will now be described in more detail.

Referring to FIG. 14, the sheet size sensor constitutes a set of photosensors PS2, PS3, PS4, PS5 and PS6 positioned in a predetermined array beneath the positions traversed on the input conveyor by the sheets just prior to their entrance into the folder 12. These photosensors are of the reflective type, looking directly upwardly through openings in the conveyor table, at the undersides of the sheets so that when the sheet is present directly above a photosensor a current is generated in it, and when the sheet is absent no such current is generated. The light sources are again preferably LED's. The diagonal drive belt 23 and the guide wall 95 assure, as is conventional, that a predetermined edge of each sheet lies and travels along the inner edge of the wall, so as always to move along a predetermined path.

PS6 is located so that when an A-size document (e.g. $8\frac{1}{2}'' \times 11''$) oriented in the document mode (e.g. with its longest dimension transverse to the conveyor) first reaches the position in which its leading edge covers PS6, it will not at that time cover any of the other photosensors. Accordingly, a current produced in PS6, with no current in the other photosensors P2–P5, indicates that an A-size (DOC) sheet is present.

When an A-size sheet in the drawing orientation (long dimension parallel to direction of conveyor motion)reaches PS6, as shown in the figure it will cover both PS6 and PS3 simultaneously but not P2, P4 or P5, providing an unambiguous indication of the presence of the A-size (DWG) sheet.

Similarly, when a B-size sheet in the drawing orientation reaches PS6, only PS6, PS2 and PS3 are covered by the sheet and hence actuated. For a C-size sheet in drawing orientation, the only covered photocells are PS6, PS5, PS2 and PS3, while for the D-size sheet in drawing orientation the covered and actuated photocells are PS6, PS5, PS4, PS3, PS2, all as shown in FIG. 14. These conditions are summarized in Table II, for the engineering fold (first five entries), then for the "book" fold (next five entries) and finally for the DIN (European) fold. The principles and details of such size and orientation sensing arrays are known in the art, and need not be described further here.

It is noted that the same sensing array is suitable for distinguishing among A-4 sheets in the document orientation, A-4 sheets in the drawing orientation, and A-3 sheets, A-2 sheets and A-1 sheets when the latter European standard sizes are printed by printer 10.

Accordingly, the size and, in the case of an A-size sheet, the orientation of the sheet, on the input conveyor are unambiguously indicated by the set of HIGH-LOW levels on the wires in the line 91 from the sheet-size sensor to the electrical controller.

In this preferred embodiment an additional photosensor PS1 is provided beneath the folder input conveyor upstream of the photosensors PS2–PS6. This photosensor may be used for several purposes not directly related to the present invention; for example, it may be used to operate circuitry which shuts down the system if no print appears for, say, five minutes after start up, or as a reference for a jam indication produced when PS6, for example is not actuated within the time normally required for a sheet to travel from PS1 to PS6.

As to the conveyor motion sensor 84 of FIG. 15, as shown in FIG. 5, it constitutes the combination of a ferromagnetic gearlike member 96 secured to the shaft of main motor drive shaft 97, together with a commercial magnetic proximity sensor 98 positioned adjacent the periphery of the gear, so as to produce one output pulse each time one of the gear teeth rotates past it. Such devices are well known in the art and need not be described in detail. As an example only, with the conveyor moving at 110 feet/minute, the gear has 84 teeth so that one pulse is produced for approximately each 0.00875 inches of motion of the conveyor. The latter pulses are supplied to electrical controller 90, where they are preferably used to cause upcounting in a resettable counter of conventional form, as more fully set forth hereinafter.

The reference position sensor PS7 for pocket P1 produces a current when the sheet is absent at the sensor, and substantially zero current when the sheet is present. Accordingly, the time at which it changes from its current to no-current condition is a direct indication of the time at which the leading edge of the sheet reaches the reference position sensor. This reference signal, in the form of a change of level, is also supplied to the controller 90 to indicate the exact time of arrival of a sheet at the reference position sensor.

It will be appreciated from the foregoing that the number of pulses from the conveyor-motion sensor which occur after the reference position sensor senses the leading edge of the sheet is directly indicative of the position of that leading edge of the sheet in the pocket. Accordingly, to arrest the advance of the sheet into the pocket at any desired position, it is only necessary to actuate the clamping apparatus when a counter in the electrical controller, which is started by the reference signal, reaches a predetermined count representing the desired clamp position of the sheet. Knowing that each pulse corresponds to 0.00875 inch of advance of the sheet, and knowing how far the sheet is to advance into the pocket past the reference sensor, one can readily calculate the number of pulses to be counted before clamping is to be initiated.

A convenient and preferred way to accomplish this control is to utilize in the controller circuits a microprocessor having a memory in which the number of pulses to be counted is stored; when, for example, the control circuits sense that a B-size sheet is to be folded, as indicated by the existence of signals from PS6, PS2 and PS3, the output of the counter is supplied to a comparator which compares the counter output with the appropriate stored pulse total, and when the comparison circuit detects that the number of counted pulses equals the stored number, a signal is sent to actuate the clamping circuit. A one-shot multivibrator device is preferably triggered by the comparison circuit output, the duration of the one-shot pulse being equal to the time for which the paper is to be clamped, e.g. 200 milliseconds, so that the clamp will release before the paper begins to be pulled out of the pocket by the rollers producing the fold.

In this way then, the advance of the sheet into the pocket is arrested at any desired position as required to produce the fold line in the desired position. With the parameters described above, the successive positions of arrest can differ from each other by as little as 0.00875", i.e. the amount by which the conveyor moves between successive pulses, and for all practical purposes the arrest position of the sheet can be considered as continuously adjustable by selection of the stored number of pulses to be counted after occurrence of the reference pulse. This provides a wide degree of flexibility in use of the equipment, since the same pocket can at different times produce fold lines differing in location by very small distances.

While not entirely necessary, it is preferred to provide some electrical adjustment for the exact timing of the reference pulse utilized to initiate counting; for example, and preferably, the reference pulse may be passed through another adjustable one-shot multivibrator providing a small minor adjustable amount of delay, the latter adjustment being made by observation of the exact position of the fold line produced during test operations and adjustment of the manual control, until the system produces the fold line in precisely the desired position. When such delay is employed, the stored pulse-count number should be correspondingly reduced, so that the sum of the reference pulse delay and the count-time has the desired total value for arresting the sheet at the desired position. An adjustable one-shot or monostable device may be used for this vernier adjustment of the delay time.

What has been described immediately above is generally how the size of one particular sheet, such as a B-size sheet, is sensed and the clamp in the second pocket operated to arrest the advance of the sheet into the pocket at the proper time to enable a suitable fold. However, to permit the sheet to enter the pocket, the corresponding second gate must also be operated to its open position before the leading edge of the sheet reaches it. Whether or not the paper is to enter the pocket is a function of the size of the sheet, and accordingly the information from PS2 to PS6 indicative of the size of the sheet is also utilized to open the gate or to leave it closed, depending upon what is required to effect the desired folding. In the case of an ordinary B-size sheet folded in engineering fold, the single fold is made in the second pocket.

Thus, for each size of sheet there is a corresponding desired condition of the gate for each of the four parallel-fold pockets, and a stored count value corresponding to the distance of desired advance into each pocket whose gate is open for the entry of a sheet. Table II lists a number of sheet sizes and orientations, the type of folding to be produced for each size and orientation, the photosensors which are actuated to identify each such sheet in each orientation, and whether certain gates or the ejector are to be operated or not operated for that particular sheet. "PASS" under the heading "FOLD TYPE" means that no fold is produced. As mentioned previously, Table I shows, for each size and orientation of sheet, the gate position and the distance from the leading edge of the sheet at which the fold is to be produced, as well as whether or not the ejector in the cross-fold unit is to be operated for that particular sheet size and orientation.

It will therefore be appreciated that in actuality each of the five photosensors associated with the size sensing operation as shown in FIG. 14, and each of the reference position sensing devices PS7 to PS10, and each of the four gates for the first four pockets, are separately connected to the electrical controller 90 which, in response to the information from the sheet-size sensor controls the gates and the effective stop position produced by the clamping action, so as to produce the appropriate folding for that particular sheet size and orientation. Table I then constitutes, in effect, a program matrix which can be embodied in hardware or software, and in the present example is preferably provided in conventional manner by a microprocessor within the controller circuit.

A control circuit for each of the above three general types of folding (Engineering, book, DIN) may be embodied on a card, the cards being replaceable and interchangeable as desired. Alternatively, the machine can be provided with all three cards, with a control system for connecting any selected one of the three cards into the system to accomplish the desired type of folding.

FIG. 16 shows in block diagram form the nature of one particular simplified form of controller for controlling the gates and clamping operations in accordance with sheet size which can be embodied in hardware form or in software form. At the top left are shown the 5 size-sensing photosensors PS2 to PS6, and at the top right the 5 reference sensors PS7 to PS10 and PS12 at the five pockets.

The outputs of PS2 to PS6 are supplied to Sheet Size Decoder 100, which responds by producing a signal indicating the size of sheet entering the folder. The latter signal is supplied over line 102 to sequencer 102A, which is also supplied with printer commands. The output of the sequencer is supplied over line 103 to Gate Select 104, which responds by setting the solenoids of each of the gates G1 to G4 and the ejector to the appropriate state for that size of sheet. The output of the sequencer is also supplied to Count Selector 106. The Count Selector supplies to Count Comparator 108 whichever stored count is appropriate for arresting the sheet advance into the various pockets.

To this end, a Stop-Count Memory 110 is provided containing First, Second, Third and Fourth Pocket Counts 112, 114, 116 and 118, and an X-fold Count 120, which store the counts corresponding to the various distances by which the sheet is to enter each of the four parallel-fold pockets and the cross-fold pocket. For example, if a B-size sheet is sensed, the Count Selector will pass on to the Comparator from Second Pocket Count 114 the appropriate stored count for a B-size sheet in pocket P2 well before the sheet is advanced into Pocket P2.

The Counter 122 is reset and restarted by signals from PS7 to PS10 and PS12 respectively, as the sheet reaches the reference sensor at any of these pockets. At each such time, Counter 122 begins to count the pulses from conveyor motion sensor 84 and supplies its running count to Comparator 108. When the latter count equals that previously inserted into the Comparator by Count Selector 106, the Comparator supplies an output signal over line 124 to a One-shot 126, which responds by producing a pulse of predetermined duration and supplying it to Relay Driver 128; this latter pulse occurs at the time when the corresponding clamp is to be actuated. One-shot 127 is the above-described manual vernier delay adjustment. The clamps CL1, CL2, CL3, CL4 and CL5 in FIG. 16 each represent the pair of clamps actually used at each of the pockets P1–P5, the clamps of each pair being operated simultaneously and in parallel with each other.

The Relay Driver output is applied to Clamp Select 130, which selects the clamp solenoids to which the actuating signal is to be supplied. It is enabled to do this by supplying it with the reference sensor signals from PS7 to PS10 and PS12; for example, it is informed by the presence of a reference signal from PS7 that the clamp for pocket P1 is the next clamp to be actuated by the Relay Driver pulse.

The arrangement of FIG. 16 can be embodied entirely in hardware form, but is preferably implemented at least in part by software. A flow chart showing the appropriate steps in the preferred process is shown in FIG. 18, and a corresponding preferred system diagram is shown in FIG. 19.

Referring to FIG. 18, as shown at 300 the statuses of the size-sensing and pocket reference photosensors, and any commands from the printer and collator, are supplied to the microprocessor control system of FIG. 19. This enables an optional step shown at 302, in which the system is monitored for jams by measuring the time of travel of the sheet between various photosensors; if a jam is indicated, the conveyor is stopped as shown at 304. There are several combinations of photosensors which can be used for jam-detecting purposes, wherein the time at which the sheet reaches a particular photosensor and the time at which it reaches another photosensor is counted and, if it is substantially above the normal time required for such travel, a jam is indicated and the conveyor stopped. These are not essential to the present invention.

Assuming there is no jam, the system is enabled, by the inputting shown at 300, to select from computer memory the fold sequence appropriate for the sheet size sensed and for the fold type commanded by the printer, as shown at 308 in FIG. 18. Conveyor motion pulses are supplied to the system as shown at 310, and in response to these pulses the conveyor-motion sensor pulses which occur after the corresponding pocket reference pulse are counted, and the count compared with the appropriate stored count, as shown at 312. The system then selects and operates the appropriate pocket clamp momentarily when the input count reaches the selected stored count, as shown at 314.

Referring to the corresponding system of FIG. 19, showing the preferred embodiment of the invention, a microcontroller unit 400 (MCU) is employed, which may be an Intel Type 8039 unit. The microcontroller receives its instructions from the program ROM 494, which while shown separately for convenience is functionally a part of the microcontroller. The MCU is supplied from input buffer 402 with the signals from the printer and the collator. The interrupt and encoder circuitry 404, which also supplies the MCU, inputs the encoder pulses generated by the conveyor-motion sensor, and preferably also inputs a source of real-time signals from clock 405 which can be used in the jam-sensing operation.

Block 410 represents an amplifier which receives and amplifies the signals supplied thereto from the various photosensors. The latter amplified signals are supplied to the two octal buffers 412 and 414, by way of the multiplexer 415 whose purpose will be described later herein. The signals from input buffer 402 and from interrupt and encoder circuitry 404 enable the MCU to select the appropriate folding sequence for the sheet size sensed and for the type of fold commanded. Thus, the signals from the printer and collator registered in input buffer 402 and supplied to the MCU 400, together with the photosensor signals stored in the octal buffers 412 and 414, enable the MCU to select the combination of gate, ejector and clamp solenoids appropriate for the size of sheet sensed and for the fold type to be executed. The latter information in the octal buffers is transferred to the MCU by sequential polling, by way of read-write bus 416, I/O address decode 418 and bus 420.

As described previously, the equipment may include a jam monitoring system which indicates, for example, that the transit time for a sheet between pockets exceeds two seconds, indicating a jam. Assuming there is no jam, the microcomputer waits for the reference photosensor in that fold pocket being approached by a sheet to indicate when and whether the leading edge of the paper appears, by producing a photosensor output signal. Upon the occurrence of such photosensor reference signal the microcomputer unit begins to count the pulses arriving from the encoder circuitry 404, and when a stored count specific to that particular pocket and fold type has been reached, the microcomputer sends a signal over bus 422 to corresponding external monostables or "one-shots" which provides a controllably adjustable delay as previously described, in order to fine tune the pocket depth at which the fold is to occur. The delayed signal from the monostables returns to the microcomputer via octal buffer 423, whereupon the MCU addresses and actuates the appropriate clamping solenoids momentarily, via the octal latches 430, 432 and 434, as desired.

Also shown in FIG. 19 is photoemitter drive circuitry 440 which runs constantly under control of a timer 441 to activate the L.E.D. photoemitters of the photosensors intermittently and in a sequential manner. One reason for this is to conserve power, the rate of turning them on and off being high compared with the speed of the conveyor. However, in addition, this switching action is used to discriminate against noise by synchronously sampling the outputs of the photosensors by means of a multiplexer (MUX) 415, synchronized with photoemitter drive circuitry 440, prior to supplying them to the octal buffers 412 and 414. The timer 441 provides synchronization between the photo-emitter drive circuits and the MUX.

Information exchange between the collator and printer on one hand and the MCU is handled via the input buffer 402 as stated above, and by the octal latch 436. In this example, the operating program is stored in the Program ROM 494, and accessed by the MCU through octal latch 496.

More particularly as to the steps performed in this preferred embodiment, during specific intervals in time the microcontroller fetches its next instruction from the program ROM. The specific moment at which the next instructions is fetched is determined by the line 600 from the microcontroller. The line 602 had, at a previous moment, latched the lower eight bits of the address, at which the instruction resides, into the Octal Latch 496. The other line 604 then establishes the complete address at which the instruction is located. The instruction is then made available to the microcontroller via line 610 and line 612. This process is performed ad infinitum during the normal operation of the circuit.

The first set of instructions received by the MCU directs it to scan the INPUT BUFFER 402 in order that the printer may pass information to the MCU. The information received from the printer will direct the MCU as to the type of fold it is to perform (i.e., BOOK, DIN, ENGINEERING or OVERSIZE). The MCU is also scanning photosensor PS1 to determine if paper has entered the infeed conveyor. The photosensor circuitry includes the photo-emitter drive circuitry 440 which activates the light-emitting diode that is transmitting a beam of light to the photosensor. When the beam of light is either broken, as in the case of the pocket photosensors, or reflected by the paper, as in the case of the infeed, crossfold and exit conveyors, the interruption is detected by the MCU via the amplifier 410. The information from the photosensor circuitry is then buffered in Octal Buffers 412 and 414 in order to protect the MCU from any unexpected electrical occurrences.

The individual OCTAL BUFFER which is to be read is then selected by the MCU via the RD/WR/ line 416 and the line 670. When the signal from PS1 is finally detected at the beginning of the infeed conveyor, the MCU is preferably instructed by the program to load values to a register which keeps track of the time the paper is in transit, for jam detection purposes, as well as information which will indicate the location of the jam if it occurs. The jam detection process is carried out via an interrupt procedure which allows the processor to perform other duties while the timing is in process. The interrupt is essentially a clock pulse which enters the processor via the interrupt circuitry 404.

Upon detection of the PS1 signals the processor then begins to scan PS6 at the infeed conveyor. If a sheet is detected at PS6 within the predetermined amount of time this indicates that the paper has successfully arrived without jamming; this process may be repeated in a similar manner throughout the folder. The processor then proceeds to determine the size of the paper by also scanning photosensors PS2, PS3, PS4 and PS5. Once the size has been determined, the microcontroller then opens the gates appropriate to the fold being performed. This process of activating the gates is accomplished via the OCTAL LATCHES 430,432. The latch which is to be written to is selected by the lines 416 and 670. Once the latch is selected a binary word is put out onto the data bus 612. This word then selects the desired clamping solenoid via the drive circuitry.

The processor will now scan the photosensor which resides in the pocket specific to the fold being performed. When the paper is detected at that photosensor, a count is loaded into a register within the MCU. This register is then incremented until the count overflows. Once this occurs the MCU then proceeds to pulse the monostable circuitry over line 422. This circuitry allows for an adjustable delay that can be accessed for adjustment by a service technician. The delay is adjusted by changing the resistance of a potentiometer that exists on the circuit board. After the monostable circuitry is pulsed, it will remain in a particular logic state for a predetermined amount of time. Once that amount of time has been exhausted, the monostable circuitry will return again to a rest state, at which time the MCU will activate the clamp solenoid appropriate to the particular pocket being used. Line 422 selection is controlled by the processor in a manner identical to the selection of the gate solenoids. The fold is now performed by activating the clamping solenoids at the selected pocket. The selection of the pocket solenoids is also performed in a manner identical to the selection of the gate solenoids.

Once the pocket folds have been performed, the paper is transferred to the crossfold conveyor. At this point the paper is detected at PS12. The next function the MCU functions is to activate the injector solenoid. This solenoid is activated in a manner identical to the other solenoids in the system as described above. The injector solenoid causes the paper to pass into the crossfold pocket, where it is either folded or ejected depending on the size of the paper being folded. The procedure that the MCU follows for the crossfold pocket is identical to that for the other pockets in that it loads a count to a register, counts up, pulses the monostable circuitry to acquire the service-adjustable delay, then activates the crossfold solenoid alone if the ejector is not required, or activates the ejector in conjunction with the crossfold solenoid for folds requiring the ejector function. The paper then passes onto the upper conveyor 24. At this point in time the paper size is passed to the collator via the OCTAL LATCH 434, over the line designated on the block diagram for communications to the printer and the collator. This is done by again selecting the appropriate OCTAL LATCH via lines 416 and 670 which in turn activate the address decoder 418. The decoder then makes the selection. OCTAL LATCH 436 also passes the information to the printer as to where a jam exists when it occurs.

Input buffer 402 handles the incoming information that originates at the printer and the collator. This buffer is scanned as stated above when the processor checks the status of the printer.

There are many other ways of accomplishing the above-described functions, either by hardware, software or a combination of both, so long as they serve to sense when a sheet has entered a pocket to the desired depth and to operate a clamping means for the sheet momentarily, at the appropriate time to produce a fold at the desired position.

FIGS. 17A, 17B, 17C and 17D show schematically the basic clamping operation. FIG. 17A shows the pocket P2 with reference photosensor PS8 near its top and with clamping solenoid CL2 along its side. As shown, a sheet 500 has just reached the photosensor, to initiate a reference signal. The sheet then advances until it reaches the position shown in FIG. 17B, when it has advanced a distance D past the reference photosensor, and the clamping solenoid has just been operated to arrest the sheet by clamping it against the inside wall of pocket P2. In FIG. 17C the sheet is shown as the buckle is being formed, and in FIG. 17D as the sheet is being nipped between the rollers to effect the desired fold, at which time the solenoid has retracted its plunger to release the sheet for exit from the pocket.

The distance D is that which is measured by counting the number of pulses from the conveyor-motion sensor which occur after the reference pulse, as described previously. It will be understood that D is not, in general, the same as the distance from the leading edge to the fold line, and instead is substantially less by about the distance between the photosensor and the nip of rollers. It is, however, the pulse count corresponding to D which is stored in the controller memory and used to control actuation of the clamping solenoid.

FIG. 1 shows the locations of the photosensor s PS11, PS13 and PS14, as well as of the proximity sensor PS15; FIG. 10 shows the position of photosensor PS12. PS11 is used to time the triggering of the cross-fold means, and when the folder includes a date stamper and a tab applicator, to time the triggering of these; since a date stamper and tab applicator are not a part of the present invention, they have not been shown. PS12 is the reference photosensor for the cross-fold pocket. PS13 may be used to detect that a sheet has left the folder without a jam; PS14 may be used to index the start-up of the collator drum so it will step to the next position to receive the next sheet, and PS15 to stop the collator drum at the next position to receive the next sheet.

The preferred embodiment of the invention specifically shown and described operates to arrest the advance of the sheet into a pocket by clamping it against the inside of the pocket. It is recognized that the sheet may be clamped between members specifically provided in the pocket for this purpose, and may for example be clamped between two members extending into the pocket on opposite sides of the sheet, both of which members may be movable to clamp the sheet between them when actuated. Also, although best results have been obtained with the described arrangement in which the proper position for clamping is determined in response to the extent of advance of the sheet into the pocket, some of the advantages of the invention may be obtained by measuring the time for which the sheet has advanced into the pocket and operating the clamping means at a predetermined time interval following the time at which the sheet reaches a reference position.

Thus while the invention has been described with particular reference to specific embodiments thereof, in the interest of complete definiteness, it will be understood that it may be embodied in a variety of forms diverse from those specifically shown and described, without departing from the spirit and scope of the invention as defined by the appended claims.

TABLE I

| SHEET | 1st Pocket (Top) | | 2nd Pocket (Bottom) | | 3rd Pocket (Top) | | 4th Pocket (Bottom) | | Cross-Fold Pocket | |
|---|---|---|---|---|---|---|---|---|---|---|
| SIZE | Gate | Stop | Gate | Stop | Gate | Stop | Gate | Stop | Stop | Ejector |
| A DOC | X | — | X | — | X | — | X | — | (11) | X (PS12) |
| A DWG | X | — | X | — | X | — | X | — | (8½) | X (PS12) |
| B | X | — | — | (8½) | X | — | X | — | (11) | X (PS12) |
| C | X | — | — | (11) | X | — | X | — | (8½) | — |
| D | X | — | — | (8½) | — | (8½) | — | (8½) | (11) | — |
| A DOC | X | — | X | — | X | — | X | — | (11) | X (PS12) |
| A DWG | X | — | X | — | X | — | X | — | (8½) | X (PS12) |
| B | X | — | X | — | — | (4 9/16) | — | (4 9/16) | X (PS12) | |
| | | | | | | | | (11) | | |
| C | — | (7 1/16) | — | (7 1/16) | X | — | X | — | | — |
| D | — | (6 17/32) | — | (6 17/32) | — | (6 17/32) | — | (6 17/32) | | — |
| A4 DOC | X | — | X | — | X | — | X | — | (297) | X (PS12) |
| A4 DWG | X | — | X | — | X | — | X | — | (210) | X (PS12) |
| A3 | X | — | X | — | — | (115) | — | (115) | (297) | X (PS12) |
| A2 | — | (198) | — | (198) | X | — | X | — | (297) | — |
| A1 | — | (162) | — | (162) | — | (163) | — | (163) | (297) | — |

TABLE II

| SHEET TYPE | FOLD TYPE | PHOTO SENSORS ACTIVATED | PROGRAM TO BE PERFORMED |
|---|---|---|---|
| A DOC | Pass | PS6 | Ejector enabled |
| A DWG | Pass | PS6+PS3 | Ejector enabled |
| B | Engr. | PS6+PS2+PS3 | 2nd Gate Open, Ejector enabled |
| C | Engr. | PS6+PS5+PS2+PS3 | 2nd Gate Open |
| D | Engr. | PS6+PS5+PS4+PS2+PS3 | 2nd, 3rd, 4th Gates Open |
| A DOC | Pass | PS6 | Ejector enabled |
| A DWG | Pass | PS6+PS3 | Ejector enabled |
| B | Book | PS6+PS2+PS3 | 3rd, 4th Gates Open, Ejector enabled |
| C | Book | PS6+PS5+PS2+PS3 | 1st, 2nd Gates Open |
| D | Book | PS6+PS5+PS4+PS2+PS3 | All Gates Open |
| A4 DOC | Pass | PS6 | Ejector enabled |
| A4 DWG | Pass | PS6+PS3 | Ejector enabled |
| A3 | Din | PS6+PS2+PS3 | 3rd, 4th Gates Open, Ejector enabled |
| A2 | Din | PS6+PS5+PS2+PS3 | 1st, 2nd Gates Open |
| A1 | Din | PS6+PS5+PS4+PS2+PS3 | All Gates Open |

What is claimed is:

1. In apparatus for folding a sheet of paper-like material along a selected one of a variety of possible folding lines, comprising a sheet-receiving pocket, means for feeding said sheet along a path leading to and entering into said pocket, sheet arresting means for arresting the advance of said sheet into said pocket at a controllable position while said feeding means continues to feed said sheet into said pocket to cause said sheet to buckle outside the entrance to said pocket, and means adjacent said entrance operative upon arrest of said advance for grasping the buckled portion of said sheet external to and adjacent to the entrance to said pocket to form a fold line, and for withdrawing said sheet from said path and said pocket, the position of which fold line depends upon how far said sheet has advanced into said pocket before being arrested, the improvement wherein:

said sheet arresting means comprises sheet clamping means positioned adjacent to said pocket and actuatable to bear against and clamp said sheet momentarily at a location between the leading and trailing edges thereof with respect to said pocket and thereby momentarily arrest its advance into said pocket; and control means for controlling said clamping means to vary the position of the sheet in said pocket at which said clamping means is actuated to arrest said sheet, thereby to control the position on said sheet of the fold line.

2. The apparatus of claim 1, wherein said clamping means comprises at least one clamping element movable between a first position spaced from a side of said sheet in said pocket and a second position in which it bears aganist said side of said sheet, and electrically operable solenoid means for controlledly moving said clamping means between said first and second positions.

3. The apparatus of claim 1, wherein said clamping means comprises a plurality of clamping elements spaced apart cross a side of said pocket.

4. The apparatus of claim 1, wherein said control means comprises sensing means for sensing when said sheet reaches a predetermined reference position with respect to said pocket and for sensing when said sheet has advanced further into said pocket by a predetermined distance with respect to said reference position, and means for actuating said clamping means momentarily when said sheet has advanced into said pocket by said predetermined distance.

5. The apparatus of claim 4, wherein said sensing means comprises a sensor for producing electrical pulses indicative of the distance by which said sheet has advanced with respect to said reference position, and said control means is responsive to said pulses to actuate said clamping means when the distance of conveyor advance indicated by said pulses equals said predetermined distance.

6. The apparatus of claim 5, comprising conveyor means for advancing said sheet, said conveyor means comprising rotational means which rotates a predetermined angular amount for each unit of advance of said conveyor, and wherein said sensor comprises means for producing a pulse signal each time said rotational means rotates by said predetermined angular amount.

7. The apparatus of claim 1, wherein said control means comprises means for sensing the size of said sheet and for supplying size-indioating signals to said control means to control said position of said fold line in accordance with the size of said sheet.

8. The apparatus of claim 1, wherein said control means comprises:

first means for sensing the size of said sheet, and for producing a first signal representative of said size, second means for sensing when said sheet has advanced to a predetermined reference position in said pocket and for producing a third signal representative thereof, third means for sensing the advancing motion of said sheet into said packet and for producing a second signal indicative of the extent of said advance, and circuit means responsive to said first, second and third signals for producing a clamping signal when said sheet has advanced into said pocket by a predetermined distance.

9. The apparatus of claim 8, comprising conveyor means for advancing said sheet, wherein said third sensing means comprises means for producing electrical pulses at a rate proportional to the rate of movement of said conveyor means, and wherein said circuit means comprises counting means for counting the number of said pulses occurring after said sheet has advanced to said predetermined reference position and for applying an actuating signal to said clamping means when said counting means has counted a predetermined number of said pulses determined by the size of said sheet.

* * * * *